US007771036B2

(12) United States Patent
Ono

(10) Patent No.: US 7,771,036 B2
(45) Date of Patent: Aug. 10, 2010

(54) INK-JET RECORDING APPARATUS

(75) Inventor: Yoshihiko Ono, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 818 days.

(21) Appl. No.: 11/716,784

(22) Filed: Mar. 12, 2007

(65) Prior Publication Data

US 2008/0012894 A1 Jan. 17, 2008

(30) Foreign Application Priority Data

Jul. 14, 2006 (JP) ..... 2006-193922

(51) Int. Cl.
*B41J 2/17* (2006.01)
*B41J 2/01* (2006.01)

(52) U.S. Cl. ..... 347/96; 347/101

(58) Field of Classification Search ..... 347/95, 347/96, 98, 100, 101
See application file for complete search history.

(56) References Cited

U.S. PATENT DOCUMENTS 7,367,666 B2 * 5/2008 Doi ..... 347/100
7,399,045 B2 * 7/2008 Nishida et al. ..... 347/14

FOREIGN PATENT DOCUMENTS

| | | |
|---|---|---|
| JP | 2895410 | 5/1999 |
| JP | 3397605 | 4/2003 |
| JP | 2003-341033 | 12/2003 |
| JP | 2004-188656 | 7/2004 |

* cited by examiner

*Primary Examiner*—Stephen D Meier
*Assistant Examiner*—Geoffrey Mruk
(74) *Attorney, Agent, or Firm*—Fildes & Outland, P.C.

(57) ABSTRACT

The ink-jet recording apparatus includes: a conveyer that conveys a recording medium; a recording head that ejects an ink and a processing solution; an ejection controller that controls ejection of the ink and the processing solution from the recording head; and a double side printer that prints on both surfaces of the recording medium to forming an image on each surfaces. Respective ejection of the ink and the processing solution is controlled so that respective amounts of the ink and the processing solution applied per unit area is less under a double-sided printing mode than the respective amount of the ink and the processing solution applied per unit area under a single-sided printing mode, and so that a reduction ratio of the amount of the ink applied per unit area is larger than one of the processing solution per unit area.

8 Claims, 11 Drawing Sheets

ORIGINAL FONT

EXAMPLE OF THINNING OUT BY STAGGERED MASK WITH EDGES LEFT BEHIND

EXAMPLE OF THINNING OUT WITH 75% MASK

EXAMPLE OF THINNING OUT WITH STAGGERED MASK

INK-JET RECORDING APPARATUS

CROSS-REFERENCE TO RELATED APPLICATIONS

This application is based on and claims priority under 35 USC 119 from Japanese Patent Application No. 2006-193922 filed Jul. 14, 2006.

BACKGROUND

1. Technical Field

The invention relates to an ink-jet recording apparatus.

2. Related Art

A printing method using an ink jet method has advantageous in that an apparatus can be made smaller, noise is low, and running costs are low. However, various requirements have been imposed on the ink-jet method having such advantages for enhancing convenience of utility.

With regard to complying with these requirements and solving the problems pointed out, a method, wherein a different amount of a printability improving liquid is applied in response to each printing mode, has been proposed for reducing the capacity of the power source of the apparatus, for reducing the cost of the apparatus and for enabling the apparatus to be small size. It has been also proposed to reduce the amount of application of the printability improving liquid per unit area of a printing material as the number of scanning on the same printing area is smaller, or to permit the kind of the printability improving liquid different depending on the printing mode.

It has been also proposed for printing on both surfaces to select, when the double-sided printing mode is selected, either a printing mode using a processing solution for applying the processing solution on a printing medium or a low concentration printing mode for reducing the amount of the applied ink on the printing medium in order to always secure good quality of printing.

It has been also disclosed to automatically select a printing mode most suitable for circumstances in order to avoid ink colors on the top and back faces from being mixed. In this method, an optimum printing mode is discriminated by allowing the printing mode to correspond to identification information whether printing information is a text or an image by separating image zones.

SUMMARY

According to an aspect of the invention, there is provided an ink-jet recording apparatus including an ink-jet recording apparatus comprising: a conveyinger that conveys a recording medium; a recording head that ejects an ink and a processing solution onto the recording medium conveyed by the conveyer; an ejection controller that controls ejection of the ink and the processing solution from the recording head based on image information; and a double side printer that prints on both surfaces of the recording medium to form an image on each surface, the ejection of the ink and the processing solution being controlled by the ejection controller so that the respective amounts of the ink and the processing solution applied per unit area are less in a double-sided printing mode, which prints on both surfaces of the recording medium, than respective amounts of the ink and the processing solution applied per unit area in a single-sided printing mode, which prints only on one surface, and so that a reduction ratio of the amount of the ink applied per unit area is larger than a reduction ratio of the amount of the processing solution applied per unit area.

BRIEF DESCRIPTION OF THE DRAWINGS

Exemplary embodiments of the present invention will be described in detail based on the following figures, wherein.

DETAILED DESCRIPTION

Figure 1:
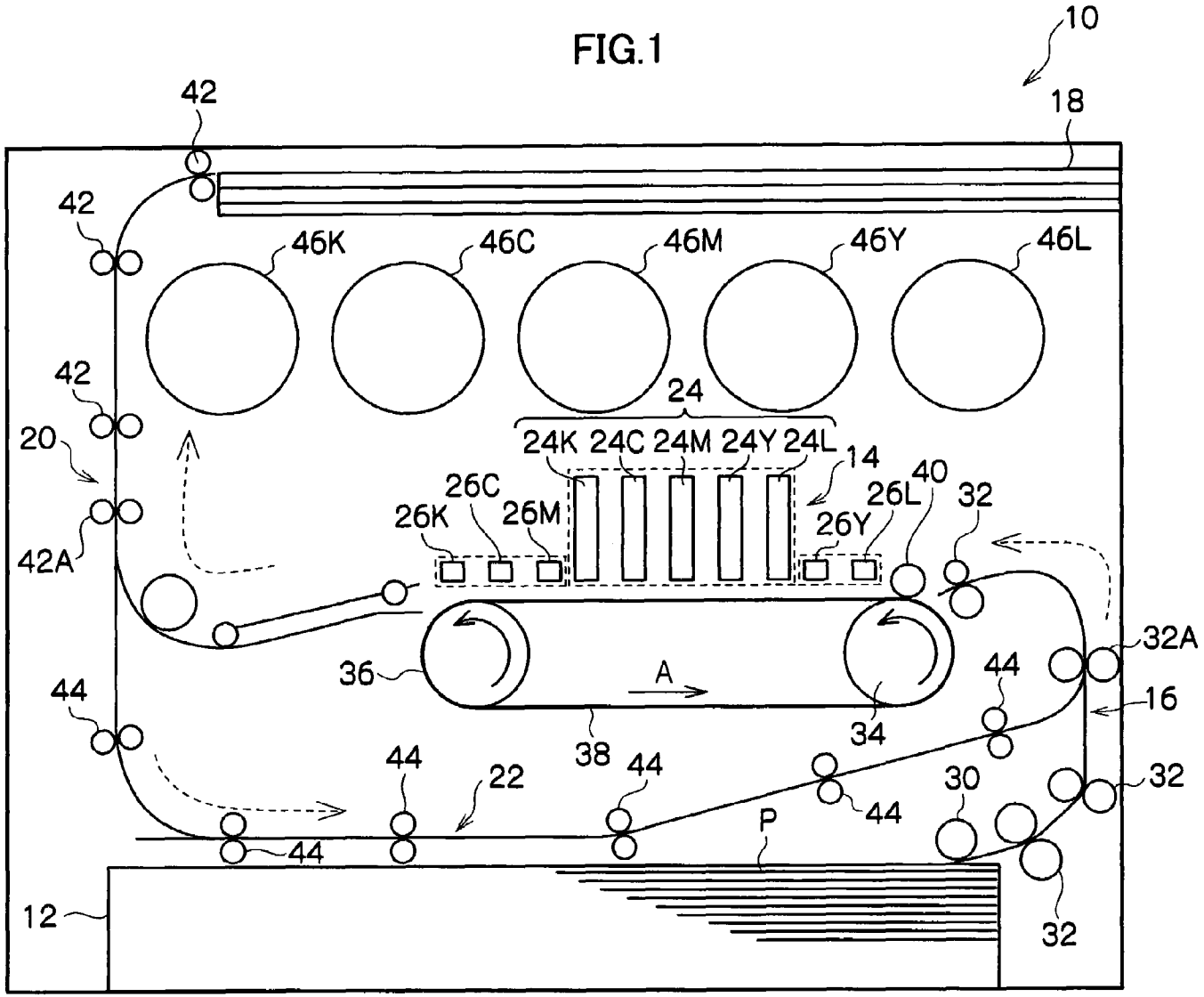
FIG. 1 schematically illustrates an example of a double-sided ink-jet recording apparatus (a printer) of the two-liquid printing system according to an exemplary embodiment.

The present invention will be described in detail below. In the present specification " . . . to . . . " represents a range including the numeral values represented before and after "to" as a minimum value and a maximum value, respectively.

The ink-jet recording apparatus according to an exemplary embodiment comprises: An ink-jet recording apparatus comprising: a conveyer that conveys a recording medium; a recording head that ejects an ink and a processing solution onto the recording medium conveyed by the conveyer; an ejection controller that controls ejection of the ink and the processing solution from the recording head based on image information; and a double side printer that prints on both surfaces of the recording medium to form an image on each surface. The ejection controller controls the ejection so that the respective amounts of the ink and the processing solution applied per unit area is reduced in a double-sided printing mode for printing on both faces of the recording medium than in a single-sided printing mode for printing only on one surface, and so that a reduction ratio of the amount of the ink applied per unit area is larger than a reduction ratio of the amount of the processing solution applied per unit area.

That is, the respective amounts of the ink applied and processing solutions per unit area are reduced in the double-sided printing mode than in single-sided printing mode in the invention, while the amount of application is controlled so that the reduction ratio is larger for the processing solution than for the ink.

The construction of the ink-jet recording apparatus will be described, and then the ink and processing solution used in an exemplary embodiment will be described. When an exemplary embodiment is described with reference to drawings, the same reference numeral is given to the same member, and repeated descriptions are omitted.

1. Ink-Jet Recording Apparatus

FIG. 1 shows a schematic illustration of an example of a double-sided ink-jet printer (ink-jet recording apparatus) 10 mounting a recording head having a printing width wider than the width of the recording area of the recording medium (may be abbreviated as FWA (full width array) hereinafter).

In FIG. 1, a recording paper P in a paper feeding tray 12 is taken out with a pickup roller 30 one by one, and is sent to an ejecting portion 14 by a first conveying portion 16. The first conveying portion 16 has a plural conveyance roller pairs 32 for conveying a paper, which are disposed at appropriate positions, and a recording paper P is re-supplied to a prescribed conveyance roller pair 32A from an inversion portion 22. The ejecting portion 14 is provided with conveying belt 38 which is winded by a driving roller 34 disposed on an upstream side in a paper conveying direction and a follow-up roller 36 disposed on a downstream side. The conveying belt 38, which is circulation-driven in an arrow A direction of FIG. 1, is disposed for facing a printing surface of a recording paper P with an ink jet recording head 24. At an upper portion of a driving roller 34, a nip roller 40 is slidingly contact against the conveying belt 38 from a surface side.

A second conveying portion 20 has plural conveying roller pairs 42 for conveying a paper, which are disposed at appropriate positions, and a prescribed conveying roller pair 42A may send a recording a paper P to an inversion portion 22. In a double-sided printing mode, a paper is inverted at a conveying roller pair 42A, and the paper is conveyed to an inversion portion 22. The inversion portion 22 has plural conveying roller pairs 44 for conveying a paper, which are disposed at appropriate positions, and conveys a recording paper P from a conveying roller pair 42A to a conveying roller pair 32A at the position where a printed surface becomes an upper side, allowing a back surface to be printed by a single pass.

Although not shown in the figure, the image recording apparatus has CPU for controlling an image forming apparatus 10, and has an ejection controller that controls ejection of a processing solution and an ink, a machine controller that controls driving of a carriage motor or a linefeed motor, a detector and/or switch controller that controls operating a detector and/or switch, a display element controller that controls a display panel, and a memory portion for memorizing data of an optical density of an image and an ejection amount of a processing solution and an ink respectively, or pre-inputted data. CPU operates data as necessary, and directs each controlling portion.

The ink-jet recording apparatus according to an exemplary embodiment may further have a heater that heats the recording medium P so as to accelerate drying speed by heating the recording medium on which the ink and processing solution are applied. The heater may be provided at the position opposed to the recording head 24 via the carrier belt 38, and the downstream in a direction (direction A) of conveyance of the recording medium P from the recording head 24.

Figure 2:
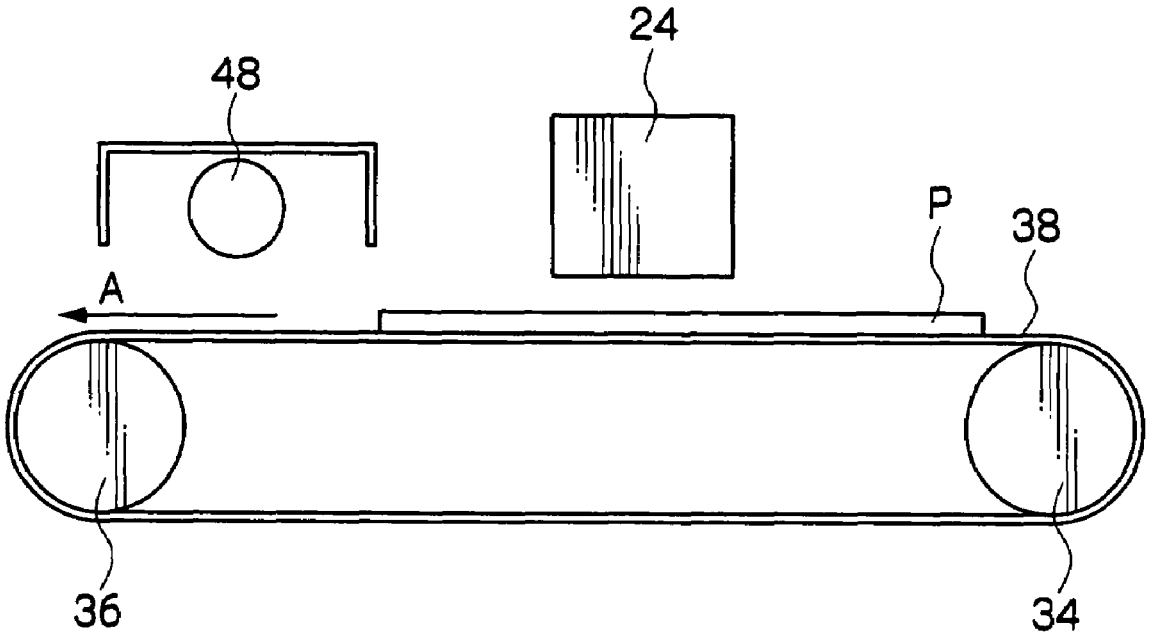
FIG. 2 illustrates a layout of a heater.

FIG. 2 shows a schematic illustration of the ink-jet recording apparatus having a heater 48 disposed downstream of the recording head 24 in a direction of conveyance of the recording medium P.

Figure 3A:
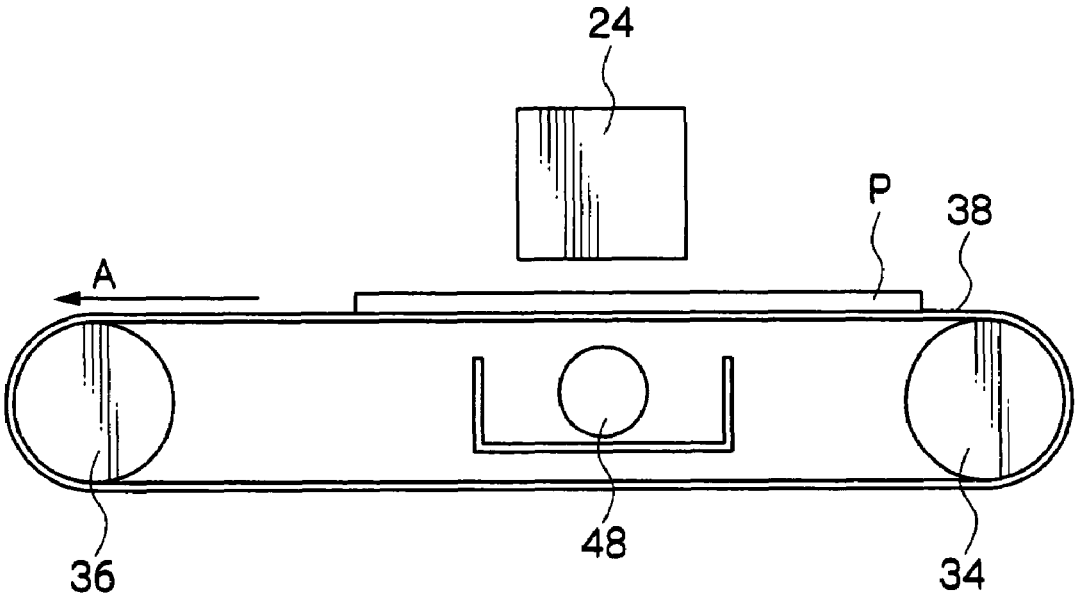
FIG. 3A schematically illustrates an example of the ink-jet recording apparatus according to an exemplary embodiment in which the heater is located at a position opposed to the recording head 24.
Figure 3B:
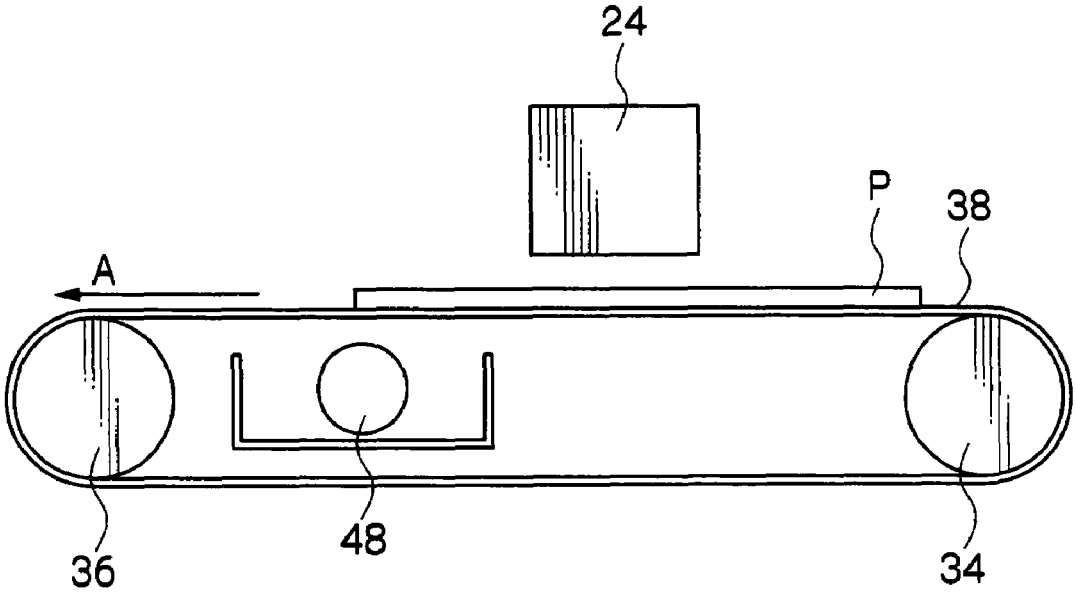
FIG. 3B schematically illustrates an example of the ink-jet recording apparatus according to an exemplary embodiment in which the heater is placed at a downstream side of the recording head in a direction of conveyance of the recording medium.

FIGS. 3A and 3B schematically illustrate the ink-jet recording apparatus having the heater 48 disposed at a position opposed to the recording head 24 via the carrier belt 38. While the heater 48 is disposed at the position opposed to the recording head 24 via the carrier belt 38 in FIG. 3A, the heater 48 may be disposed downstream of the recording head 24 in the direction (direction A) of conveyance of the recording medium P, while the heater is placed at an opposed side to the recording head 24 via the carrier belt 38.

The heaters 48 may be simultaneously placed at the positions opposed to the recording head 34 via the carrier belt 38 (FIGS. 3A and 3B), and the downstream of the recording head 24 in direction (direction A) of conveyance of the recording medium P (FIG. 2).

The ink-jet recording head 24 preferably uses a thermal ink-jet recording method or piezoelectric ink-jet recording method from a viewpoint of the effect for improving bleeding of the ink and bleeding between colors.

The ink-jet recording apparatus according to an exemplary embodiment employs a two-liquid printing method that an ink and a processing solution, having an action for coagulating and/or insolubilizing the ink components, are ejected so that two liquids contact to one another to form an image. The ink-jet recording head 24 is arranged in a direction orthogonal to a conveying direction of a recording medium, has a printing region corresponding to the width of the recording medium, and comprises FWA 24L, 24Y, 24M, 24C and 24K for ejecting the processing solution and ink. FWA 24L, 24Y, 24M, 24C and 24K are connected to ink tanks 46L, 46Y, 46M, 46C and 46K, respectively, through respective liquid feed passageways (not shown) such as tubes, and inks and processing solution are supplied from corresponding ink or liquid tanks.

Maintenance units 26L, 26Y, 26M, 26C and 26K are provided for maintenance of the ink-jet recording heads 24 (FWA) such as filling of the ink into the head, wiping of the surface of the nozzle and purge (flushing) for preventing the ink form being thickened.

While FWA corresponding to the width of the paper sheet by arranging the nozzle array on the nozzle surface over the entire width of the recording area of the recording medium P is described as an example of the recording head 24 in FIG. 1, the ink-jet recording head of the present invention is not restricted thereto, and the recording head may have a nozzle array (printing width) smaller than the recording area of the recording medium P. Such recording head is used by allowing a pair of the recording head to move in a direction perpendicular to the direction of conveyance of the recording medium P.

Figure 4:
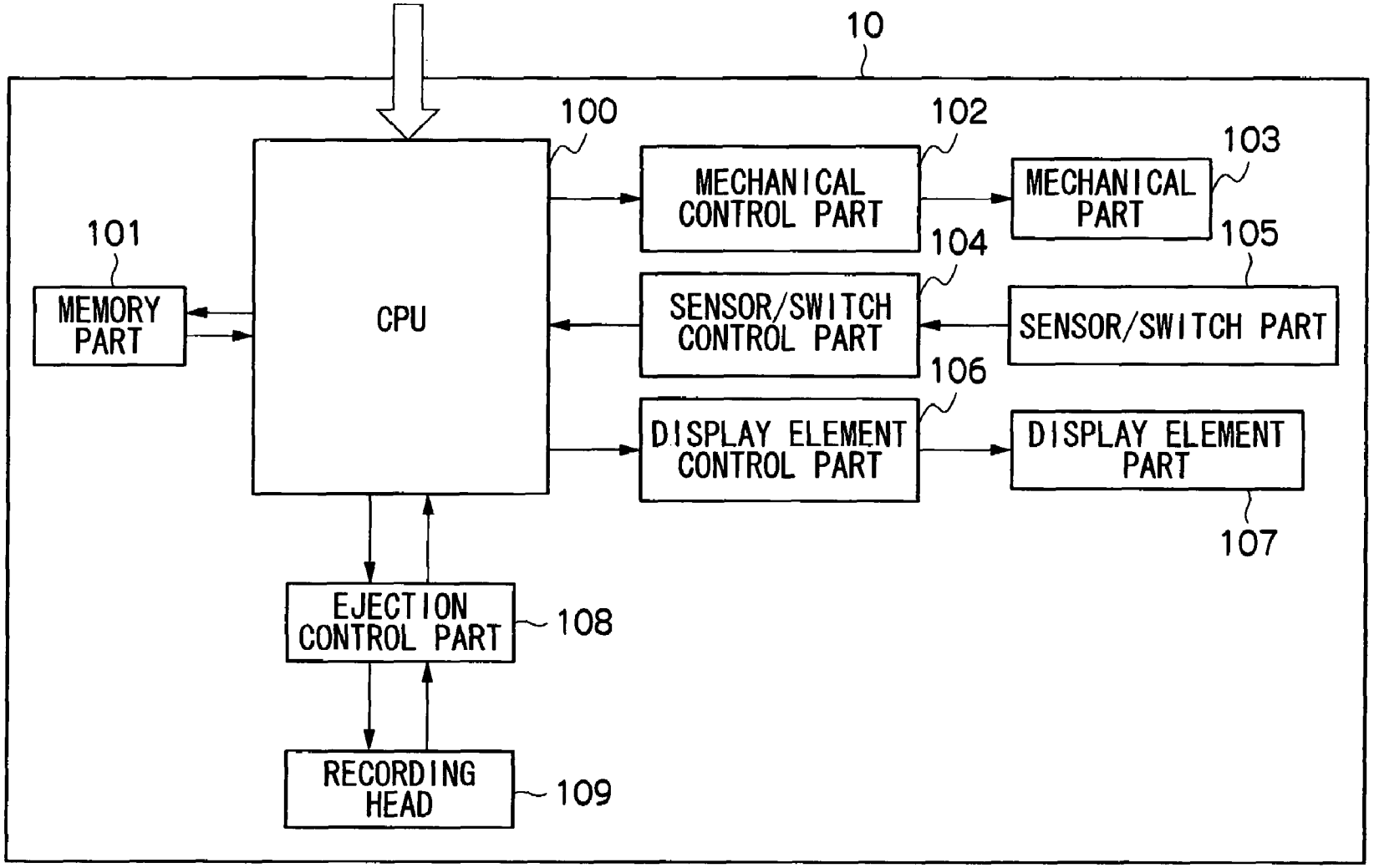
FIG. 4 is a block diagram of the ink-jet recording apparatus according to an exemplary embodiment.

FIG. 4 shows a block diagram of the ink-jet recording apparatus 10 according to an exemplary embodiment.

Data of letters and images to be printed (referred to as "image data") and other data are transferred to a memory part 101 under the control of CPU 100. A mechanical control part 102 actuates mechanical parts 103 such as the carriage motor and line feed motor by the instruction from CPU 100. The detector/switch control part 104 sends signals from various detectors and switch 105 to CPU 100, and the signal is transferred to the memory part 101 under the control of CPU 100. The display element control part 106 controls the display panel 107 by the instruction from CPU 100. The ejection control part 108 controls the recording head 109 by the instruction from CPU. CPU 100 executes arithmetic operation based on data stored in the memory part 101, and sends instructions to each control part.

2. Control of the Amounts of Ink and Processing Solution Applied

A method that printing speed is accelerated is employed in the two-liquid printing system using the ink and processing solution, and deterioration of optical density and image quality are suppressed.

The relation between the amount of the ink applied and the amount of the processing solution applied will be described.

Figure 5:
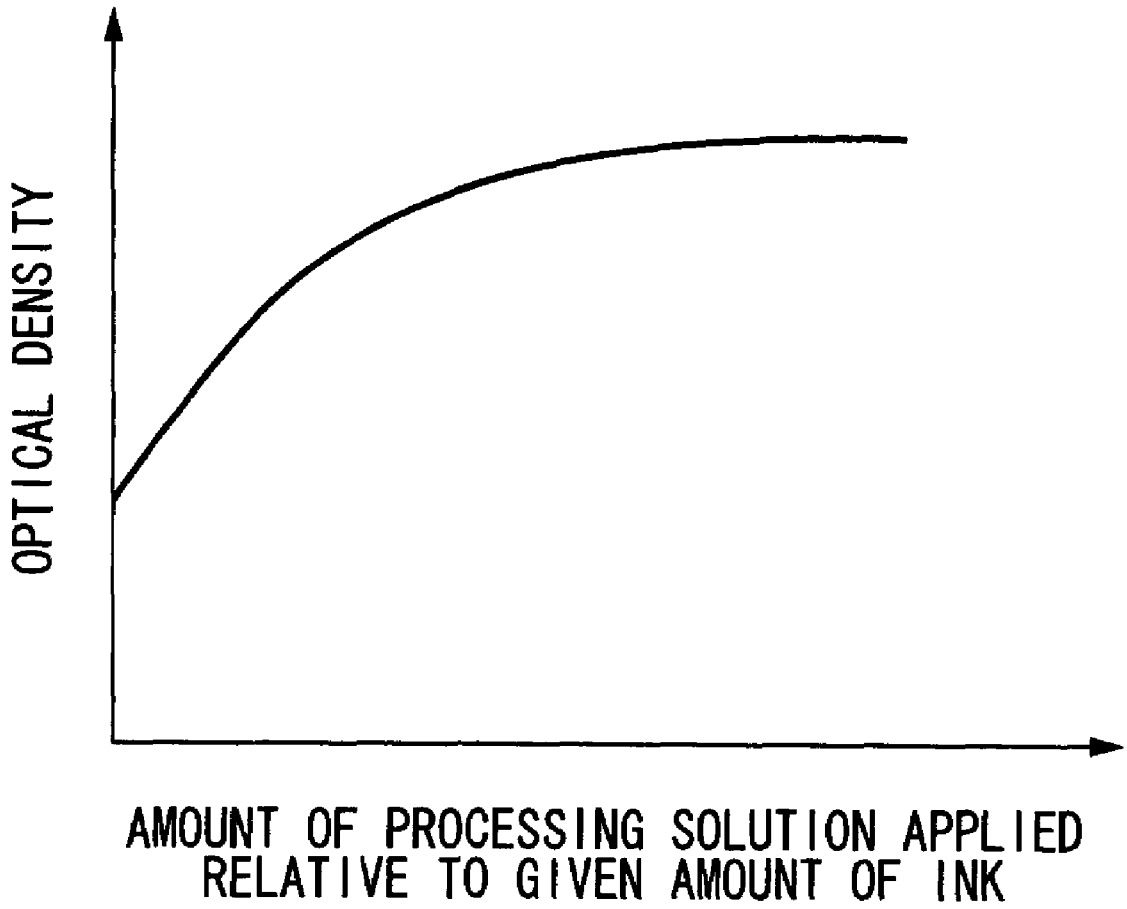
FIG. 5 is a graph showing the change of the optical density when the amount of the processing solution applied is increased with regard to a given quantity of the ink.

Since the processing solution contains a compound for insolubilizing or coagulating the components in the ink, or for thickening the ink, a given optical density may be obtained by applying the processing solution at a predetermined proportion to the ink. While the optical density gradually increases, as shown in FIG. 5, by increasing the amount of the processing solution applied per unit area, the optical density is almost saturated even if the processing solution is applied at more than a given proportion.

Accordingly, the amount of the processing solution applied per unit area is preferably approximately from 3 to 50% by volume, and more preferably approximately from 5 to 30% by volume, with regard to 100% by volume of the amount of the ink applied per unit area, in terms of obtaining an image with high optical density in the single-sided printing mode.

When plural inks are used for forming a color image, the amount of the processing solution applied with regard to the total amount of the ink applied is preferably in the above-mentioned range, and the range is preferably approximately from 15 to 25% by volume in the single-sided printing mode.

The respective amounts of the ink and the processing solution applied per unit area are controlled so that the amounts are reduced in the double-sided printing mode as compared to the single-sided printing mode, while the respective amounts of the ink and the processing solution applied are controlled so that the reduction ratio of the amount of the processing solution applied is larger than the reduction ratio of the amount of the ink applied.

The ink and processing solution may be applied so as to be adjacent to one another or to overlap to one another, as long as the ink and processing solution are in contact with one another.

With respect to the order of the ink and the processing solution applied, the ink is preferably applied after the processing solution has been applied.

The reduction ratio of the amount of application will be described below.

Supposing, for example, that the amount of the ink applied per unit area is 100% by volume in the single-sided printing mode and the amount of the ink applied per unit area is reduced to 80% by volume onto the recording medium in the double-sided printing mode, then the reduction ratio of the amount of the ink applied in the double-sided printing mode is calculated as 20% by volume from the following equation:

$$[(100-80)/100]\times 100=20 \text{ (\% by volume)}$$

Supposing that the amount of the ink applied per unit area is 100% by volume in the single-sided printing mode and the amount of the processing solution applied per unit area is reduced to 25% by volume onto the recording medium in the single-sided printing mode, and that the amount of the processing solution applied per unit area is reduced to 10% by volume on the recording medium in the double-sided printing mode, then the reduction ratio of the amount of the processing solution applied is calculated to be 60% by volume from the following equation since the amount of application is reduced to 10% by volume from 25% by volume:

$$[(25-10)/25]\times 100=60 \text{ (\% by volume)}$$

In particular, ejection is controlled so that the amount of the ink applied is preferably approximately from 70 to 95% by volume, and more preferably approximately from 80 to 90% by volume, in the double-sided printing mode when the amount of the ink applied per unit area is 100% by volume in the single-sided printing mode.

Ejection is controlled so that the amount of the processing solution applied is preferably approximately from 3 to 20% by volume, and more preferably approximately from 5 to 10% by volume, in the double-sided printing mode when the amount of the ink applied per unit area is 100% by volume in the single-sided printing mode. The amount of the processing solution applied with regard to the total amount of the ink applied is preferably in the above-mentioned range when plural inks are used as when forming a color image.

While the amount of the processing solution applied per unit area is reduced in the double-sided printing mode, the processing solution is applied nonetheless. In other words, the two-liquid system is employed in both the single-sided printing mode and double-sided printing mode.

The amount of the ink or the processing solution applied per unit area is a product of the amount of the ink or processing solution per one drop and the number of pixels per unit area. One pixel herein refers to a non-dividable minimum printing unit, and is formed by one droplet.

Accordingly, the method for reducing the amount of application per unit area comprises (1) reducing the number of droplets (pixels) per unit area, or (2) reducing the amount of the liquid (the amount of a drop) per unit area. Alternatively, the amount of application per unit area may be reduced by combining these methods.

Specifically, the method for reducing the amounts of the ink and the processing solution applied includes a thin-out printing method and drop modulation printing method, or a combination of these methods may be used.

The thin-out method used in an exemplary embodiment may be changed depending on the image processing method such as a method using a filter of a staggered pattern or a given pattern, as well as arithmetic operation of the image based on coverage, brightness and color saturation of the image, and edge processing of characters and photographs.

The volume per one drop is reduced in the drop modulation method; specifically the diameter of the droplet may be modulated by controlling driving waveform applied on the piezoelectric element.

Since the optical density is determined by the amounts of the ink and the processing solution applied per unit area, the optical density is equal in both the thin-out method and drop modulation method, as long as the respective amounts of the ink or the processing solution applied is equal respectively.

The amount of the liquid (amount of a drop) per one droplet (pixel) (hereinafter, may be referred to as "amount of a drop") in the single-sided printing mode is preferably in a range approximately from 1 to 20 pl, more preferably approximately from 3 to 18 pl, and furthermore preferably approximately from 4 to 15 pl in terms of high resolution of the image.

The amount of the drop in the single-sided printing mode is preferably in a range approximately from 1 to 15 pl, more preferably approximately from 2 to 12 pl, and furthermore preferably approximately from 2 to 10 pl.

The optical density of the image is preferably approximately 1.10 or more, and more preferably approximately 1.15 or more, for practical reasons. The standby time: i.e. a period from finishing printing on one surface to starting to shift into the paper inversion unit/double-sided printer, or a period from finishing printing on one surface to advancing into the printing paper inversion unit; is preferably approximately 1.8 seconds or less, more preferably approximately 1.5 seconds or less, and furthermore preferably approximately 1.0 second or less.

Specific exemplary embodiment of the method for reducing the respective amounts of the ink and the processing solution applied is shown below.

2-1. Thin-Out Printing Method

In this method, the respective amounts of the ink and the processing solution applied per unit area on the recording medium is reduced by thinning out the number of dots in order to improve drying ability. The thin-out ratio is changed depending on whether the printing mode is the double-sided printing mode or single-sided printing mode. The thin-out ratio may also be changed in accordance with various conditions such as an image quality level.

Figure 6A:
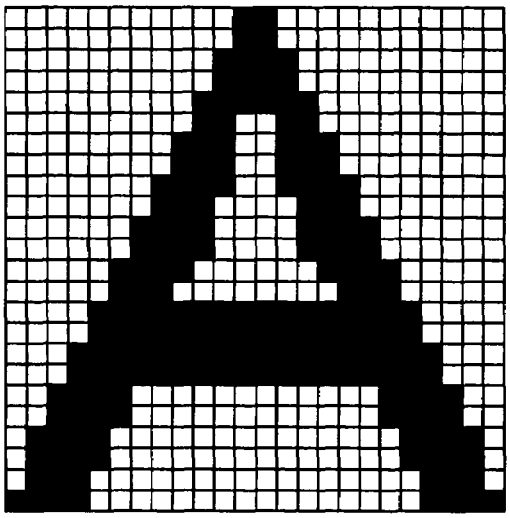
FIG. 6A shows a capital letter "A" printed by character image data without adjusting the amount of the ink applied.
Figure 6B:
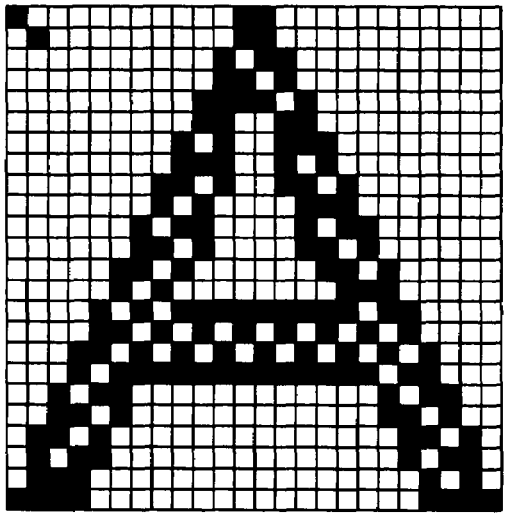
FIG. 6B shows a capital letter "A" printed by character image data when the amount of the ink applied is adjusted by thinning out the dots.
Figure 6C:
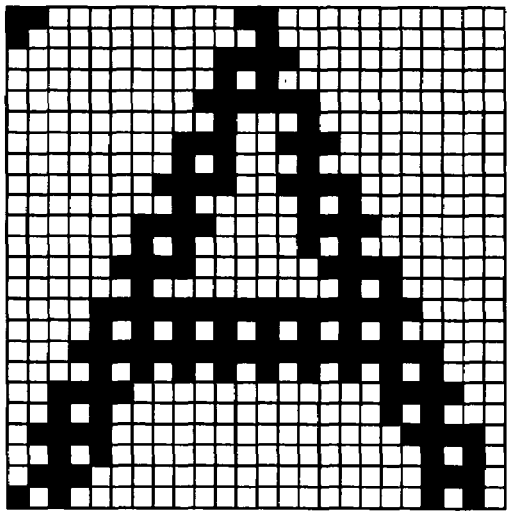
FIG. 6C shows a capital letter "A" printed by character image data when the amount of the ink applied is adjusted by thinning out the dots by another method.

The thin-out method may be selected in various manners, such as thinning out using a staggered mask (see FIG. 6D), thinning out using a staggered mask with edges left behind (see FIG. 6B), or thinning out using a 75% mask (see FIG. 6C).

Figure 6D:
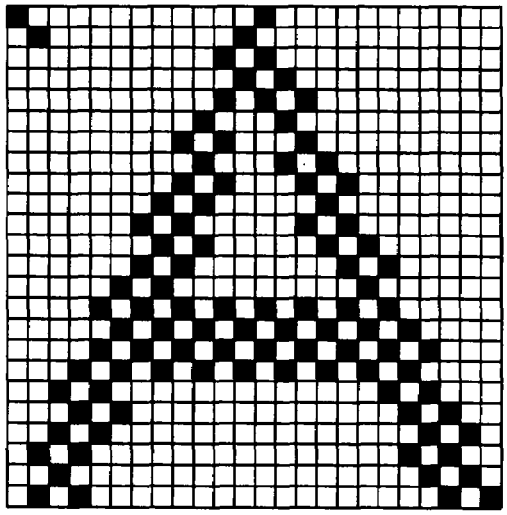
FIG. 6D shows a capital letter "A" printed by character image data when the amount of the ink applied is adjusted by thinning out the dots by a different method.

FIG. 6A shows a capital letter "A" printed by character image data without adjusting the amount of the ink applied; FIG. 6B shows a capital letter "A" printed by character image data when the amount of the ink applied is adjusted by thinning out the dots with the dots at the edge left behind; FIG. 6C shows a capital letter "A" printed by character image data when the amount of the ink applied is adjusted by thinning out the dots using the 75% mask; and FIG. 6D shows a capital letter "A" printed by character image data when the amount of the ink applied is adjusted by thinning out the dots using the staggered mask.

While the thin-out ratio of the ink may be adjusted to an extent capable of discriminating the image as a letter at the lowest, the dots is preferably thinned out so that the amount of the ink applied per unit area is approximately from 80 to 90% by volume in the double-sided printing mode when the amount of the ink applied per unit area in the single-sided printing mode is assumed as 100% by volume.

While the number of the dots of the processing solution is thinned out so that the reduction ratio of the amount of the processing solution applied is larger than the reduction ratio of the amount of the ink applied in the double-sided printing mode, the processing solution is preferably applied so that the amount of the processing solution applied per unit area in the double-sided printing mode is approximately from 5 to 10% by volume when the amount of the ink applied per unit area in the single-sided printing mode is assumed as 100% by volume.

Control of the amount of the ink applied by the ejection controller will be described with reference to the flow chart in FIG. 7. An example for forming a letter as an image will be described herein, where the number of the ink dots in the double-sided printing mode is thinned out by 15% with regard to the number of the ink dots in the single-sided printing mode.

In step 100, printing is judged whether it is double-sided printing or single-sided printing. When judged as double-sided printing, the step advances to step 102 while the step advances to step 104 when judged as single-sided printing.

The number of the dots constituting the letter is thinned out by 15% so that the shape of the letter is not changed, and the step advances to step 104 thereafter.

The image data are binarized by a dither method or an error diffusion method in step 104 followed by compressing the image data binarized in step 106, and the image data is exported to a recording head 24 as printing image data in step 108 to complete this routine.

Figure 7:
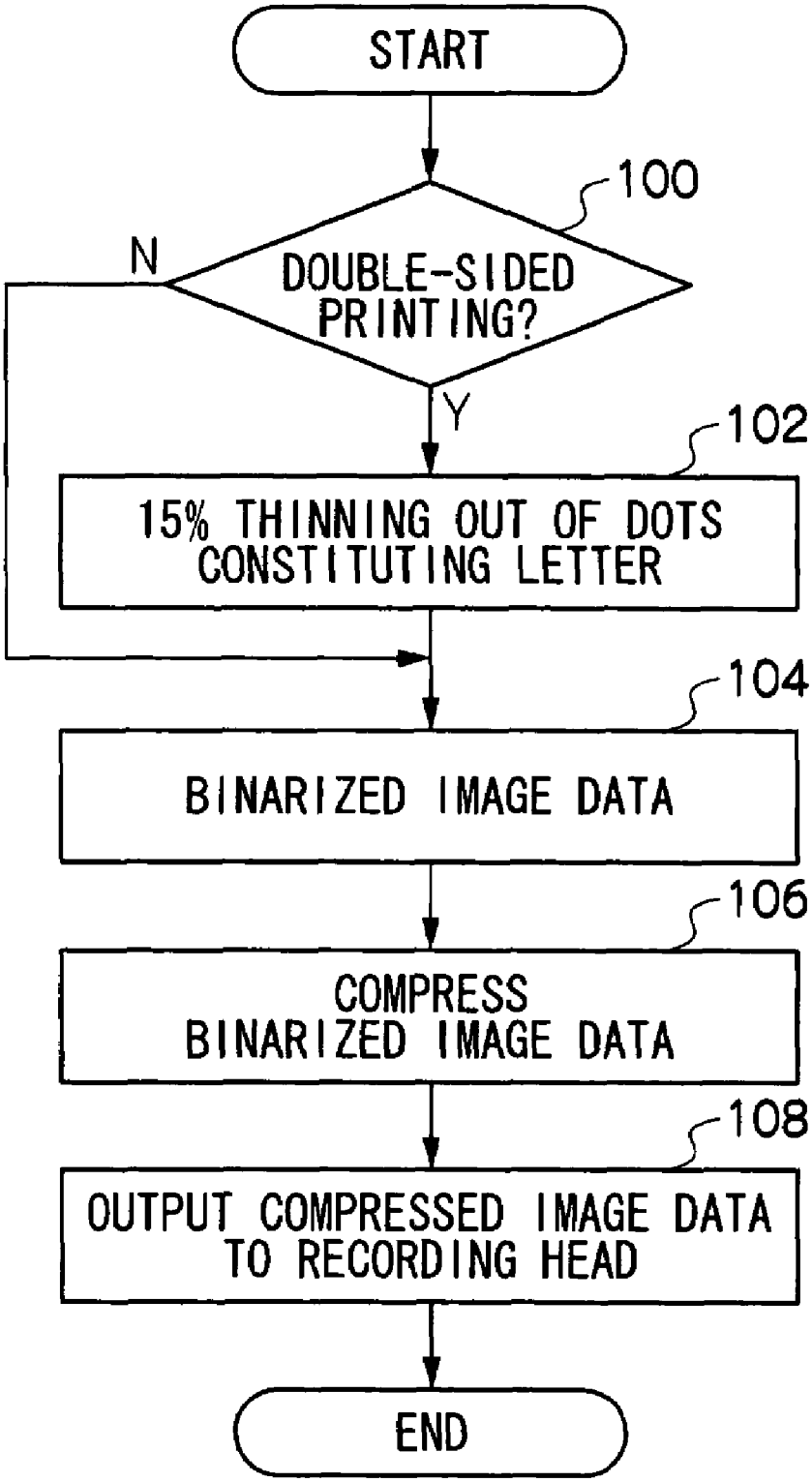
FIG. 7 is a flow chart when the printing controller controls the amount of the ink applied by thinning out the dots constituting the character.

The amount of the processing solution applied by the ejection controller may be controlled by the same method as shown in the flow chart in FIG. 7.

2-2. Drop Modulation Method

In this method, the respective amounts of the ink and the processing solution applied per unit area on the recording medium is reduced by controlling the volume per one drop (hereinafter, may be referred to as "the amount of the drop") in order to improve drying ability. The amount of the drop is controlled in accordance with whether the printing mode is double-sided printing mode or single-sided printing mode. The amount of the drop may also be changed in accordance with various conditions such as the image quality level.

Figure 8A:
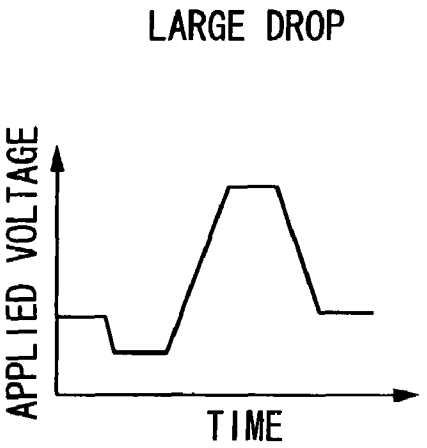
FIGS. 8A and 8B are provided for schematically illustrating the construction of the droplet ejector, a driving waveform for applying a voltage to a piezoelectric element of a droplet ejector, and a method for forming a larger ink droplet ejected corresponding to the driving waveform.
Figure 8B:
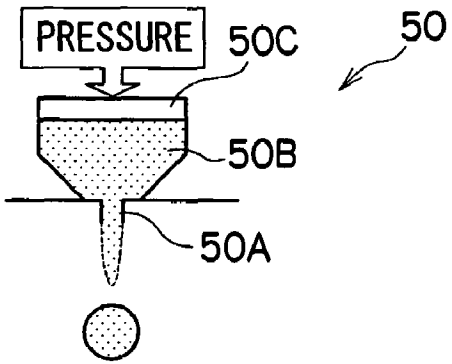
Figure 8C:
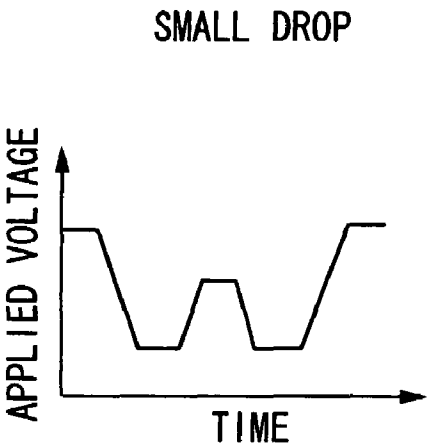
FIGS. 8C and 8D are provided for schematically illustrating the construction of the droplet ejector, a driving waveform for applying a voltage to a piezoelectric element of a droplet ejector, and a method for forming a smaller ink droplet ejected corresponding to the driving waveform.
Figure 8D:
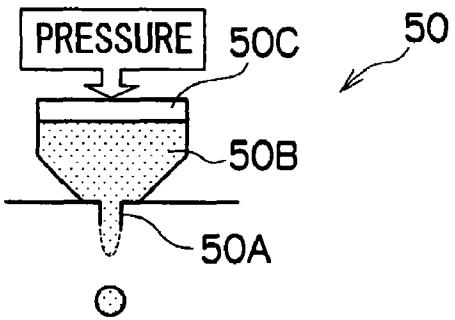

For example, a large size ink droplet (see FIG. 8B) or a small size ink droplet (see FIG. 8D) may be ejected from the nozzle 50A by controlling the drive waveform applied on the piezoelectric element 50C as shown in FIGS. 8A and 8B. When a voltage having a waveform so as not to form the dot is applied to the nozzle, the ink droplet or processing solution droplet is not ejected from the nozzle 50A (no droplets).

Figure 9:
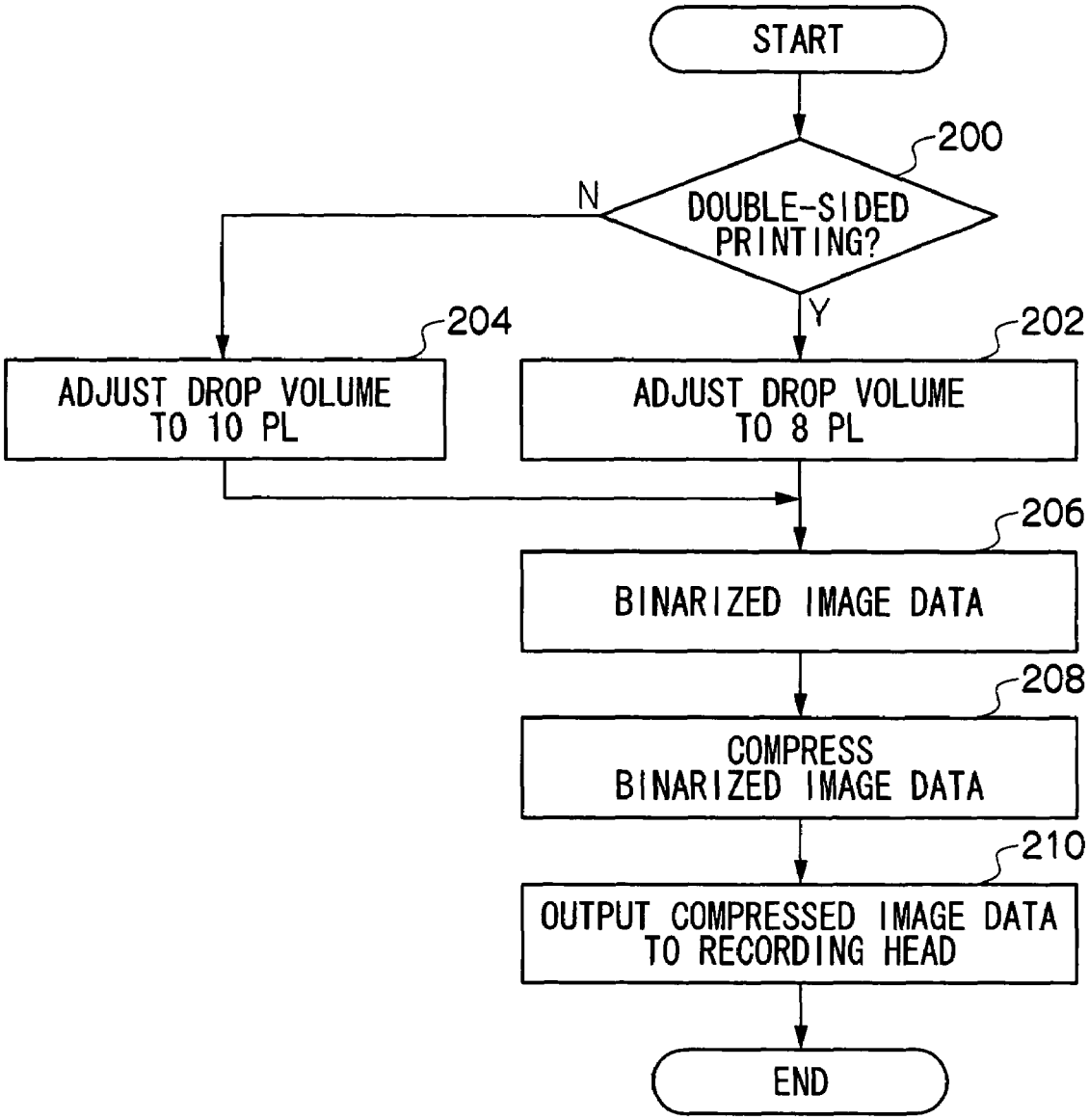
FIG. 9 is a flow chart when the printing controller controls the amount of the ink applied by changing the amount of a drop constituting the letter.

Control of the amount of the ink applied by the ejection controller will be described with reference to the flow chart in FIG. 9. In FIG. 9, when the amount of the ink drop in the single-sided printing mode is assumed as 10 pl, the amount of the ink drop in the double-sided printing mode is reduced to 8 pl (20%)

The printing mode is judged whether it is the double-sided printing mode or single-sided printing mode in step 200. When judged as the double-sided printing mode, the step advances to step 202 while the step advances to step 204 when judged as the single-sided printing mode.

The amount of the drop is adjusted to 8 pl in step 202 followed by advancing to step 206. The amount of the drop is adjusted to 10 pl in step 204 followed by advancing to step 206.

The image data are binarized by a dither method or an error diffusion method in step 206 followed by compressing the image data binarized in step 208, and the image data is exported to a recording head 24 as printing image data in step 210 to complete this routine.

The amount of the processing solution applied may be controlled by the ejection controller by the same method as shown in the flow chart in FIG. 7.

3. Application of the Ink and the Processing Solution on the Recording Medium

Figure 10:
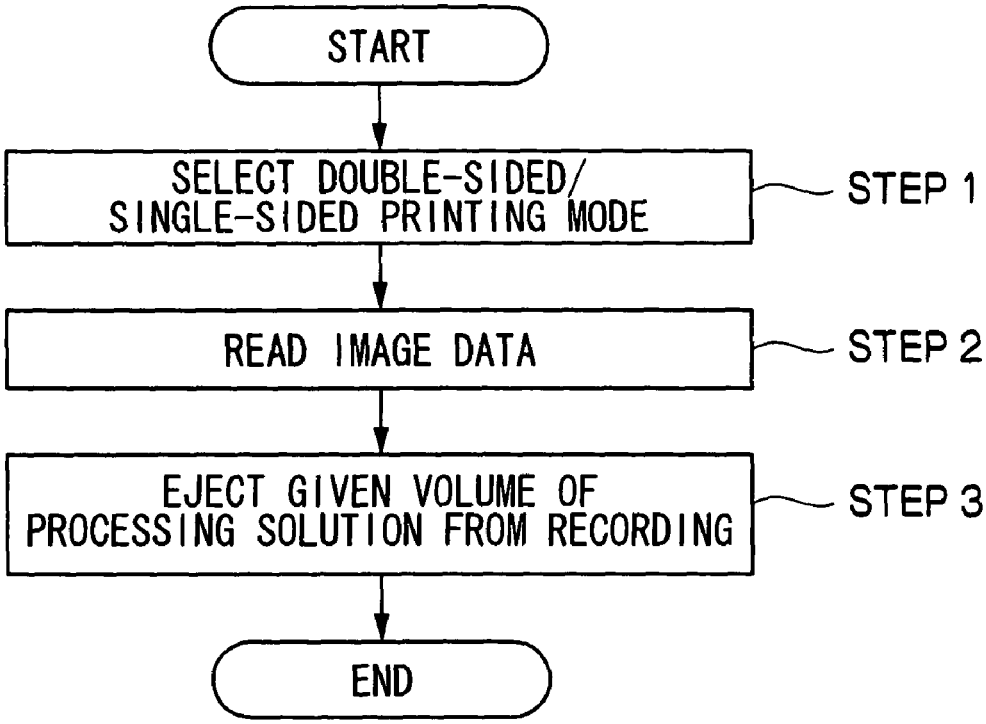
FIG. 10 is a flow chart for describing transmit/receive of signals in the block diagram shown in FIG. 4.

FIG. 10 shows a flow chart for describing transmit/receive of signals in the block diagram shown in FIG. 4.

In step 1, information relevant to the selection of the single-sided printing mode or double-sided printing mode is read from the sensor/switch part 105 such as a touch panel.

In step 2, the image data are read, and the amount of the ink applied is controlled as shown in the flow chart in FIG. 7 or 9.

In step 3, the ejection controller 108 controls the operation of the recording head 109, and the recording head 109 applies the ink and processing solution under the predetermined amount and the given number of the dots, based on the data controlled in step 2 and the data inputted to the memory part 101 in advance which is the respective amounts of the ink and the processing solution applied per unit area in the double-sided/single-sided printing mode.

Figure 11:
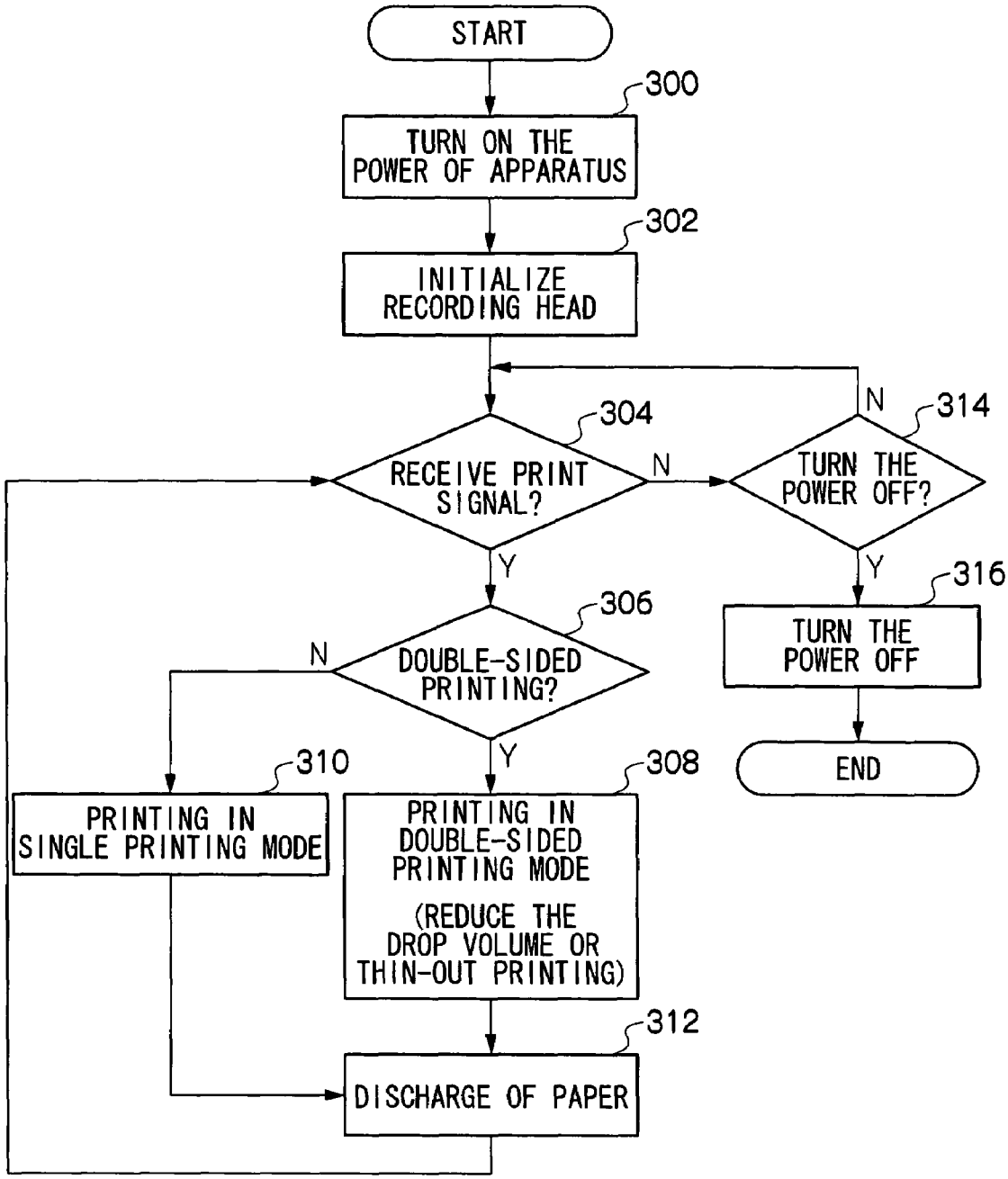
FIG. 11 is a flow chart for describing the method for applying the ink and processing solution onto the recording medium.

FIG. 11 shows a flow chart for describing the method for applying the ink and processing solution onto the recording medium.

When the power source of the ink jet recording apparatus is turned on in step 300, the step advances to step 302. The ink-jet recording head is initialized in step 302. Initialization include filling of the ink into the head, wiping of the surface of the nozzle, and purge (flushing) for preventing the ink form being thickened using the maintenance unit. Reception of the print signal, if any, is monitored in step 304, and the step advances to step 306 when the signal is received.

The printing mode is judged whether it is the double-sided printing mode or single-sided printing mode in step 306. When judged as the double-sided printing mode, the step advances to step 308, while the step advances to step 310 when judged as the single-sided printing mode.

The processing solution and the ink are applied onto the recording medium in step 308 with the memorized amounts in advance of the processing solution and the ink applied in the double-sided printing mode based on the printing image data obtained by the control step in FIG. 7 or 9, and the step advances to step 312.

The processing solution and the ink are applied on the recording medium in step 310 with the memorized amounts in advance of the processing solution and the ink applied in the single-sided printing mode based on the printing image data obtained by the control step in FIG. 7 or 9, and the step advances to step 312.

The recording medium is discharged in step 312, and the step returns to step 304.

When the print signal is not received in step 304, the power source of the ink-jet recording apparatus is turned off in step 316 by turning the power source of the printer off in step 314.

4. Ink

Details of the ink that may be used in the ink-jet recording apparatus of an exemplary embodiment will be described below.

The ink contains at least a colorant (pigment) and usually an aqueous solvent and water. Details of these components will be described below.

4-1. Colorant

While the colorant may be either a dye or a pigment, the pigment is particularly preferable. A pigment dispersed with a polymer dispersing agent (polymer compound described below), a self-dispersible pigment, a pigment coated with a resin, and a polymer graft pigment are preferable among the pigments.

While both organic pigments and inorganic pigments may be used in an exemplary embodiment, examples of black pigments include a carbon black such as a furnace black, a lamp black, an acetylene black and a channel black. In addition to a black pigment, as well as three primary color pigments of cyan, magenta and yellow, a particular color pigment such as red, green, blue, brown and white, metal luster pigments such as gold and silver, a colorless or pail color loading pigment, and a plastic pigment may be used. Pigments include particles of silica, alumina or polymer beads as cores with adhered dyes or pigments thereon, insoluble lake of dyes, colored emulsions and colored latexes. The pigment may be synthesized for exclusive use in an exemplary embodiment.

Specific examples of the black dye include, but not limited to, RAVEN 7000, RAVEN 5750, RAVEN 5250, RAVEN 5000 ULTRA II, RAVEN 3500, RAVEN 2000, RAVEN 1500, RAVEN 1250, RAVEN 1200, RAVEN 1190 ULTRA II, RAVEN 1170, RAVEN 1255, RAVEN 1080 AND RAVEN 1060 (trade names, manufactured by Columbia Carbon); REGAL 400R, REGAL 330R, REGAL 660R, MOGUL L, BLACK PEARLS L, MONARCH 700, MONARCH 800, MONARCH 880, MONARCH 900, MONARCH 1000, MONARCH 1100, MONARCH 1300 AND MONARCH 1400 (trade names, manufactured by Cabot); COLOR BLACK FW1, COLOR BLACK FW2, COLOR BLACK FW2V, COLOR BLACK 18, COLOR BLACK FW200, COLOR BLACK S150, COLOR BLACK S160, COLOR BLACK S170, PRINTEX 35, PRINTEX U, PRINTEX V, PRINTEX 140U, PRINTEX 140V, SPECIAL BLACK 6, SPECIAL BLACK 5, SPECIAL BLACK 4A and SPECIAL BLACK 4 (trade names, manufactured by Degussa); and No. 25, No. 33, No. 40, No. 47, No. 52, No. 900, No. 2300, MCF-88, MA600, MA7, MA8 and MA100 (trade names, manufactured by Mitsubishi Chemical).

While examples of the cyan pigment include C.I. PIGMENT BLUE-1, -2, -3, -15, -15:1, -15:2, -15:3, -15:4, -16, -22 and -60, the pigments are not restricted thereto.

While examples of the magenta pigment include C.I. PIGMENT RED-5, -7, -12, -48:1, -57, -112, -123, -146, -168, -184 and -202, the pigments are not restricted thereto.

While examples of the yellow pigment include C.I. PIGMENT YELLOW-1, -2, -3, -12, -13, -14, -16, -17, -73, -74, -75, -83-, 93-, -95, -97, -98, -114, -128, -129, -138, -151, -154 and -180, the pigments are not restricted thereto.

The self-dispersible pigments in water used in an exemplary embodiment refer to pigments having many water-solubilizing groups on the surface of the pigment and being able to be stably dispersed in water without using any polymer dispersing agent. Specifically, the self-dispersible pigment in water may be obtained by applying a surface modification treatment such as acid/base treatment, coupling agent treatment, polymer graft treatment, plasma treatment or oxidation/reduction treatment.

Commercially available water self-dispersible pigments such as CAB-O-JET 200, CAB-O-JET 250, CAB-O-JET 260, CAB-O-JET 270, CAB-O-JET 300, IJX-444 and IJX-55 (trade names, manufactured by Cabot), and MICROJET BLACK CW-1 and CW-2 (trade names, manufactured by Orient Chemical Industries) may be available as the water self-dispersible pigments in addition to the above-mentioned pigments subjected to the surface modification treatment.

The self-dispersible pigment as the colorant used for the ink preferably contains functional groups of carboxylic groups on the surface of the pigment.

When the colorant used for the ink has sulfonic acid groups on the surface, a polymer compound having the carboxylic acid is preferably used together with the colorant.

Pigments coated with a resin may be used as the colorant used for the ink. Such pigment is called as a microcapsular pigment. A microcapsular pigment experimentally prepared for an exemplary embodiment may be used besides commercially available microcapsular pigments such as those manufactured by Dainippon Ink & Chemicals, Inc. and TOYO INK MFG CO., LTD A polymer graft pigment is available as the colorant in the ink. The polymer graft pigment refers to a pigment on the surface of which an organic compound such as a polymer is chemically bonded.

Otherwise, the dye used may be any of water soluble dyes and dispersion dyes.

Specific examples of the water soluble dye include C.I. DIRECT BLACK-2, -4, -9, -11, -17, -19, -22, -32, -80, -151, -154, -168, -171, -194 and -195; C.I. DIRECT BLUE-1, -2, -6, -8, -22, -34, -70, -71, -76, -78, -86, -112, -142, -165, -199, -200, -201, -202, -203, -207, -218, -236, -287 and -307; C.I. DIRECT RED-1, -2, -4, -8, -9, -11, -13, -15, -20, -28, -31, -33, -37, -39, -51, -59, -62, -63, -73, -75, -80, -81, -83, -87, -90, -94, -95, -99, -101, -110, -189 and -227; C.I. DIRECT YELLOW-1, -2, -4, -8, -11, -12, -26, -27, -28, -33, -34, -41, -44, -48, -58, -86, -87, -88, -132, -135, -142, -144 and -173; C.I. FOOD BLACK-1 and -2; C.I. ACID BLACK-1, -2, -7, -16, -24, -26, -28, -31, -48, -52, -63, -107, -112, -118, -119, -121, -156, -172, and -208; C.I. ACID BLUE-1, -7, -9, -15, -22, -23, -27, -29, -40, -43, -55, -59, -63, -78, -80, -81, -83, -90, -102, -104, -111, -185, -249 and 254; C.I. ACID RED-1, -4, -8, -13, -14, -15, -18, -21, -26, -35, -37, -52, -110, -144, -180, -249, -257 and 289; and C.I. ACID YELLOW-1, -3, -4, -7, -11, -12, -13, -14, -18, -19, -23, -25, -34, -38, -41, -42, -44, -53, -55, -61, -71, -76, -78, -79 and -122.

Specific examples of the dispersion dye include C.I. DISPERSE YELLOW-3, -5, -7, -8, -42, -54, -64, -79, -82, -83, -93, -100, -119, -122, -126, -160, -184:1, -186, -198, -204 and -224; C.I. DISPERSE ORANGE-13, -29, -31:1, -33, -49, -54, -66, -73, -119 and -163; C.I. DISPERSE RED-1, -4, -11, -17, -19, -54, -60, -72, -73, -86, -92, -93, -126, -127, -135, -145, -154, -164, -167:1, -177, -181, -207, -239, -240, -258, -278, -283, -311, -343, -348, -356 and 362; C.I. DISPERSE VIOLET-33; C.I. DISPERSE BLUE-14, -26, -56, -60, -73, -87, -128, -143, -154, -165, -165:1, -176, -183, -185, -201, -214, -224, -257, -258, -354, -365 and -368; and C.I. DISPERSE GREEN-6:1 and -9.

The volume average particle diameter of the colorant in the ink is preferably in a range approximately from 30 nm to 250 nm. The volume average particle diameter of the colorant refers to the colorant's own particle diameter, or the diameter of the particle in the state where an additive is adhered when the additive such as a dispersing agent is adhered on the colorant. A MICRO-TRACK particle diameter analyzer (trade name, manufactured by Leeds & Northrup) is used as the measuring apparatus of the volume average particle diameter. Specifically, 4 ml of ink is placed into a measuring cell, and a diameter is measured according to a prescribed method. As a parameter to be inputted at measurement, a viscosity of ink is used as a viscosity, and a coloring agent density is used as a density of dispersed particles.

The volume average particle diameter is more preferably approximately from 50 nm to 200 nm, and furthermore preferably approximately from 75 nm to 175 nm.

The colorant of an exemplary embodiment is preferably used in a range approximately from 0.1% by mass to 20% by mass, and more preferably approximately from 1% by mass to 10% by mass, with regard to the total mass of the ink.

4-2. Polymer Substance

A polymer substance is preferably used in an exemplary embodiment as a coagulation accelerating agent or for dispersing the colorant. The polymer substance used for dispersing the colorant (pigment) is referred to as a polymer dispersing agent in an exemplary embodiment.

As a polymer substance used herein, any of a water-soluble polymer polymer, and a water-insoluble polymer polymer such as an emulsion and self-dispersible fine particles may be used, and the polymer substance may be any of a nonionic compound, anionic compound, a cationic compound, and an amphoteric compound.

Compounds having carboxylic groups are preferably used as the polymer substance of an exemplary embodiment.

Specific examples of the polymer substance used in an exemplary embodiment will be described below. A specific example of the polymer substance includes a copolymer of monomers having an α,β-ethylenically unsaturated groups or the like. Examples of the monomer having the α,β-ethylenically unsaturated group include acrylic acid, methacrylic acid, crotonic acid, itaconic acid, itaconic acid monoester, maleic acid, maleic acid monoester, fumaric acid, fumaric acid monoester, vinylsulfonic acid, stylenesulfonic acid, sulfonylated vinylnaphthalene, vinyl alcohol, acrylamide, methacryloxyethyl phosphate, bismethacryloxyethyl phosphate, methacryloxyethylphenyl acid phosphate, ethyleneglycol dimethacrylate, diethyleneglycol dimethacrylate, styrene, styrene derivatives such as α-methyl styrene and vinyl toluene, vinyl cyclohexane, vinyl naphthalene, vinyl naphthalene derivatives, acrylic acid alkyl ester, acrylic acid phenyl ester, methacrylic acid alkyl ester, methacrylic acid phenyl ester, methacrylic acid cycloalkyl ester, crotonic acid alkyl ester, itaconic acid dialkyl ester and maleic acid dialkyl ester.

A copolymer obtained by copolymerizing one or plural monomers having α,β-ethylenically unsaturated groups is favorably used as the polymer substance of an exemplary embodiment. Specific examples of the copolymer include a copolymer of a styrene and a styrenesulfonic acid; a copolymer of a styrene and a maleic acid; a copolymer of a styrene and a methacrylic acid; a copolymer of a styrene and an acrylic acid; a copolymer of a vinylnaphthalene and a maleic acid; a copolymer of a vinylnaphthalene and a methacrylic acid; a copolymer of a vinylnaphthalene and an acrylic acid; a copolymer of an acrylic acid alkyl ester and an acrylic acid; a copolymer of a methacrylic acid alkyl ester and a methacrylic acid; a copolymer of a styrene, methacrylic acid alkyl ester and methacrylic acid; a copolymer of a styrene, acrylic acid alkyl ester and acrylic acid; a copolymer of a styrene, methacrylic acid phenyl ester and methacrylic acid; and a copolymer of a styrene, methacrylic acid cyclohexyl ester and methacrylic acid.

These polymer substances are preferably selected in terms of affinity with the colorant (pigment) and polymer substance's own coagulability based on acid values. Specifically, it is preferable to use a polymer substance having an acid value in a range of from approximately 30 KOH mg/g to 150 KOH mg/g, or an acid value of 150 KOH mg/g or more and a neutralization ratio of 80% or less.

When the acid value in a range approximately from 30 KOH mg/g to 150 KOH mg/g, the acid value is more preferably in a range approximately from 50 to 120 KOH mg/g, furthermore preferably approximately from 70 to 120 KOH mg/g.

On the other hand, when the acid value is 150 KOH mg/g or more and the neutralization ratio is 80% or less, the acid value and neutralization ratio are more preferably approximately from 200 to 400 KOH mg/g and approximately from 50 to 80%, respectively, and furthermore preferably approximately from 200 to 300 KOH mg/g and approximately from 60 to 80%, respectively.

The weight average molecular weight of the polymer substance used in an exemplary embodiment is more preferably in a range approximately from 2,000 to 15,000, furthermore preferably approximately from 3,500 to 10,000.

The polymer substance is preferably added in the ink in a range approximately from 0.01% by mass to 10% by mass, more preferably approximately from 0.05% by mass to 7.5% by mass, and furthermore preferably approximately from 0.1% by mass to 5% by mass, with regard to the total mass of the ink.

4-3. Water-Soluble Solvent

Any solvents may be used in the ink so long as it is soluble in water in a proportion of 0.1% or more. Specific examples of the solvent include polyhydric alcohols, polyhydric alcohols derivatives, nitrogen-containing solvents, alcohols and sulfur-containing solvents.

Specific examples of the polyhydric alcohol include ethyleneglycol, diethyleneglycol, propyleneglycol, butyleneglycol, triethyleneglycol, 1,5-pentanediol, 1,2,6-hexanetriol, glycerin, and the like.

Specific examples of the polyfunctional alcohol derivatives include ethyleneglycol monomethyl ether, ethyleneglycol monoethyl ether, ethyleneglycol monobutyl ether, diethyleneglycol monomethyl ether, diethyleneglycol monoethyl ether, diethyleneglycol monobutyl ether, propyleneglycol monobutyl ether, dipropyleneglycol monobutyl ether, ethyleneoxide adduct of diglycerin, and the like.

Specific examples of the nitrogen containing solvent include pyrrolidone, N-methyl-2-pyrrolidone, cyclohexyl pyrrolidone and triethanolamine.

Specific examples of the alcohols include ethanol, isopropyl alcohol, butyl alcohol and benzyl alcohol.

Specific examples of the sulfur containing solvent include thiodiethanol, thiodiglycerol, sulfolane and dimethylsulfoxide.

Propylene carbonate and ethylene carbonate may also be used.

The water-soluble solvents in an exemplary embodiment may be used alone or in combination of two or more thereof.

The water-soluble solvent is used in a proportion approximately from 1% by mass to 60% by mass, and preferably approximately from 5% by mass to 40% by mass, with regard to the total mass of the ink.

4-4. Preferable Properties of the Ink

The surface tension of the ink is preferably approximately from 20 mN/m to 39 mN/m, more preferably approximately from 25 m/m to 39 mN/m, and furthermore preferably approximately from 25 mN/m to 35 mN/m.

The surface tension is measured under an environment of 23° C. and 55% RH using a Whilhelmy surface tension meter (manufactured by Kyowa Interface Science).

The viscosity of the ink is preferably approximately from 1.2 mPa·s to 15 mPa·s, more preferably approximately from 1.5 mPa·s to 10 mPa·s, and furthermore preferably approximately from 1.8 mPa·s to 8 mPa·s.

The viscosity is measure under an environment of 23° C. and a shear rate of 1400 $s^{-1}$ using Rheomat 115 (trade name, manufactured by Contraves) as a measuring apparatus.

The pH of the ink is preferable approximately from 3 to 11, more preferably approximately from 4 to 10.5, and furthermore preferably approximately from 4.5 to 10.

4-5. Water

Water is added to the ink so that the surface tension and viscosity are in the above-mentioned ranges. While the amount of addition of water is not particularly restricted, it is preferably approximately from 10% by mass to 99% by mass, more preferably approximately from 30% by mass to 80% by mass, with regard to the total mass of the ink.

5. Processing Solution

Details of the processing solution used in the ink-jet recording method of an exemplary embodiment will be described below.

The processing solution used in an exemplary embodiment contains at least a compound for insolubilizing or coagulating the components in the ink, or a compound for thickening the ink (these compounds are referred to as "coagulants" hereinafter).

Details of the components will be described below.

5-1. Coagulant

Favorable examples of the coagulant used in an exemplary embodiment include a compound for allowing the components in the ink to insolubilize or coagulate by reacting or interacting with the components in the ink, or a compound for thickening the ink. Such substances are inorganic electrolytes (including polyvalent metal salts), organic amines (cationic compounds), onium salts, organic acids and inorganic acids. Specifically, the inorganic electrolyte, organic amine compound and organic acid shown below are effectively used.

Examples of the inorganic electrolyte include salts of alkali metal ions or polyvalent metal ions; and inorganic acids, organic carboxylic acids or organic sulfonic acids. The alkali metal ions include lithium ion, sodium ion, potassium ion. The polyvalent metal ions include aluminum ion, barium ion, calcium ion, copper ion, iron ion, magnesium ion, manganese ion, nickel ion, tin ion, titanium ion and zinc ion. The inorganic acids include hydrochloric acid, bromic acid, iodic acid, sulfuric acid, nitric acid, phosphoric acid and thiocyanic acid. The organic carboxylic acids include acetic acid, oxalic acid, lactic acid, fumaric acid, citric acid, salicylic acid and benzoic acid.

Specific examples include lithium chloride, sodium chloride, potassium chloride, sodium bromate, potassium bromate, sodium iodide, potassium iodide, sodium sulfate, potassium nitrate, sodium acetate, potassium oxalate, sodium citrate, potassium benzoate, aluminum chloride, aluminum bromide, aluminum sulfate, aluminum nitrate, sodium aluminum sulfate, potassium aluminum sulfate, aluminum acetate, barium chloride, barium bromide, barium iodide, barium oxide, barium nitrate, barium thiocyanate, calcium chloride, calcium bromide, calcium iodide, calcium nitrite, calcium nitrate, potassium dihydrogen phosphate, calcium thiocyanate, calcium benzoate, calcium acetate, calcium salicylate, calcium tartarate, calcium lactate, calcium fumarate, calcium citrate, copper chloride, copper bromide, copper sulfate, copper nitrate, copper acetate, iron chloride, iron bromide, iron iodide, iron sulfate, iron nitrate, iron oxalate, iron lactate, iron fumarate, iron citrate, magnesium chloride, magnesium bromide, magnesium iodide, magnesium sulfate, magnesium nitride, magnesium lactate, magnesium acetate, manganese chloride, manganese sulfate, manganese nitrate, manganese dihydrogen phosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate and zinc acetate.

Organic amine compounds include primary, secondary, tertiary and quaternary amines, and salts thereof.

Specific examples of the organic amine compound include tetraalkyl ammonium salts, alkylamine salts, benzarconium salts, alkylpyridium salts, imidazolium salts and polyamine salts, which include isopropyl amine, isobutyl amine, t-butylamine, 2-ethykhexylamine, nonyl amine, dipropyl amine, diethyl amine, trimethyl amine, triethyl amine, dimethylpropyl amine, ethylenediamine, propylene diamine, hexamethylene diamine, diethylene triamine, tetraethylene pentamine, diethanolamine, diethylethanol amine, triethanol amine, tetramethyl ammonium chloride, tetraethyl ammonium bromide, dihydroxyethyl stearyl amine, 2-heptadecenyl hydroxyethyl imidazoline, lauryl dimethylbenzyl ammonium chloride, cetyl pyridinium chloride, stearamide methylpyridium chloride, polymer of diaryldimethyl ammonium chloride, polymer of diaryl amine, polymer of monoaryl amine, onium salts of these compounds such as sulfonium salts and phosphonium salts, or phosphoric acid esters thereof.

The organic acid is preferably represented by the following Formula (1):

Formula (1)

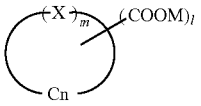

In the Formula (1), X represents O, CO, NH, NR, S or $SO_2$; and R represents an alkyl group. R is preferably $CH_3$, $C_2H_5$ or $C_2H_4OH$. X is preferably CO, NH, NR or O, and more preferably CO, NH or O.

M represents a hydrogen atom, an alkali metal or an amine. M is preferably H, Li, Na, K, monoethanol amine, diethanol amine or triethanol amine, more preferably H, Na or K, and furthermore preferably a hydrogen atom.

n is an integer of from 3 to 7. n is preferably an integer for forming a 6- or 5-membered ring, more preferably an integer for forming a 5-membered ring. m is 1 or 2.

The compound represented by Formula (1) may be a saturated or unsaturated ring, so long as the ring is heterocyclic. 1 is an integer of from 1 to 5.

Specifically, the compound represented by Formula (1) includes compounds having a structure of furan, pyrrole, pyrroline, pyrrolidone, pylon, thiophene, indole, pyridine, or quinoline, furthermore having a carboxylic group as a functional group. Specific example of the compound include 2-pyrrolidone-5-carboxylic acid, 4-methyl-4-pentanolide-3-carboxylic acid, furan carboxylic acid, 2-benzofuran carboxylic acid, 5-methyl-2-furan carboxylic acid, 2,5-dimethyl-3-furan carboxylic acid, 2,5-furan dicarboxylic acid, 4-butanolid-3-carboxylic acid, 3-hydroxy-4-pylon-2,6-dicarboxylic acid, 2-pylon-6-carboxylic acid, 4-pylon-2-carboxylic acid, 5-hydroxy-4-pylon-5-carboxylic acid, 4-pylon-2,6-dicarboxylic acid, 3-hydroxy-4-pylon-2,6-dicarboxylic acid, thiophene carboxylic acid, 2-pyrrole carboxylic acid, 2,3-dimethylole-4-carboxylic acid, 2,4,5-trimethylole-3-propionic acid, 3-hydroxy-2-indole carboxylic acid, 2,5-dioxo-4-methyl-3-pyroline-3-propionic acid, 2-pyrrolidine carboxylic acid, 4-hydroxyproline, 1-methylpyrrolidine-2-carboxylic acid, 5-carboxy-1-methylpyrrolidine-2-acetic acid, 2-pyridine carboxylic acid, 3-pyridine carboxylic acid, 4-pyridine carboxylic acid, pyridine dicarboxylic acid, pyridine tricarboxylic acid, pyridine pentacarboxylic acid, 1,2,5,6-tetrahydro-1-methylnicotinic acid, 2-quinoline carboxylic acid, 4-quinoline carboxylic acid, 2-phenyl-4-quinoline carboxylic acid, 4-hydroxy-2-quinoline carboxylic acid, 6-methoxy-4-quinoline carboxylic acid, derivatives of these compounds, and salts of these compounds.

The preferable compound represented by Formula (1) is pyrrolidone carboxylic acid, pylon carboxylic acid, pyrrole carboxylic acid, furan carboxylic acid, pyridine carboxylic acid, coumalic acid, thiophene carboxylic acid or nicotinic acid, a derivative thereof, or a salt thereof. The more preferable example is pyrrolidone carboxylic acid, pylon carboxylic acid, furan carboxylic acid or coumalic acid, a derivative thereof, or a salt thereof.

Among them, preferable examples of these compound include magnesium chloride, magnesium bromide, magnesium iodide, magnesium sulfate, magnesium nitrate, magnesium acetate, calcium chloride, calcium bromide, calcium nitrate, calcium dihydrogen phosphate, calcium benzoate, calcium acetate, calcium tartarate, calcium lactate, calcium fumarate, calcium citrate, polymer of diaryldimethyl ammonium chloride, polymer of diallylamine, polymer of monoallyl amine, pyrrolidone carboxylic acid, pylon carboxylic acid, pyrrole carboxylic acid, furan carboxylic acid, pyridine carboxylic acid, coumalin carboxylic acid, thiophene carboxylic acid, nicotinic acid, potassium dihydrogen citrate, succinic acid, tartaric acid, lactic acid and potassium hydrogen phthalate, derivatives of these compounds, or salts of these compounds. More preferable examples of these compounds include magnesium chloride, magnesium nitrate, calcium nitrate, polymer of diallyl amine, pyrrolidone carboxylic acid, pylon carboxylic acid, furan carboxylic acid and coumalin acid, derivatives of these compounds, or salts of these compounds.

These coagulants in an exemplary embodiment may be used alone, or in combination of two or more thereof.

The amount of addition of the coagulant in the processing solution is approximately from 0.01% by mass to 30% by mass, more preferably approximately from 0.1% by mass to 15% by mass, and furthermore preferably approximately from 0.25% by mass to 10% by mass with regard to the total mass of the processing solution.

5-2. Water Soluble Solvent

As a water-soluble solvent used in a processing solution, the same water-soluble solvents as those of ink can be used.

The content of the water soluble solvent used is approximately from 1% by mass to 60% by mass, preferably approximately from 5% by mass to 40% by mass with regard to the total mass of the processing solution.

5-3. Preferable Properties of the Processing Solution

The surface tension of the processing solution is preferably approximately from 10 mN/m to 38 mN/m, more preferably approximately from 15 mN/m to 37 mN/m, and furthermore preferably approximately from 15 mN/m to 35 mN/m.

The surface tension of the processing solution is preferably smaller than the surface tension of the ink. The method for measuring the surface tension of the processing solution is the same as the method for measuring the surface tension of the ink.

The viscosity of the processing solution is preferably approximately from 1.2 mPa·s to 15 mPa·s, more preferably approximately from 1.5 mPa·s to 10 mPa·s, and furthermore preferably approximately from 1.8 mPa·s to 8 mPa·s. The method for measuring the viscosity of the processing solution is the same as the method for measuring the viscosity of the ink.

The viscosity and surface tension are preferably adjusted so that expansion of the dot is larger in the ink than in the processing solution when the volume of the droplets is the same between the processing solution and ink.

The pH of the processing solution containing the compound represented by Formula (1) is preferably approximately from 1.5 to 12.0, more preferably approximately from 2.0 to 7.5, and furthermore preferably approximately from 2.5 to 6.0.

The number of particles of 5 μm or more in the mixed solution of the ink and the processing solution is preferably approximately 500 particles/μL or more, more preferably approximately from 500 particles/μL to 10,000 particles/μL, and furthermore preferably approximately from 500 particles/μL to 3,000 particles/μL.

The number of crude particles in the mixed solution of the ink and the processing solution is measured by mixing the two liquid in a mass proportion of 1:1, sampling 2 μL of the mixed liquid with stirring, and counting the number of the particles using ACCUSIZER TM770 OPTICAL PARTICLE SIZER (trade name, manufactured by Particle Sizing Systems, Inc.). The density of the dispersed particles is used as the density of the colorant as a parameter for the measurement. The density of the colorant may be determined by measuring the powder of the colorant obtained by drying the dispersion with heating using a gravitometer or pycnometer.

5-4. Water

Water is added to the processing solution in a range capable of adjusting the surface tension and viscosity within the above-mentioned range. While the amount of addition of water is not particularly restricted, it is preferably approximately from 10% by mass to 99% by mass, more preferably approximately from 30% by mass to 80% by mass with regard to the total mass of the processing solution.

5-5. Colorant

The colorant may be added to the processing solution. As a coloring agent to be contained in a processing solution, the same coloring agents as those explained as a coloring agent for an ink can be used. The colorant used is preferably a dye, a pigment having sulfonic acid or sulfonic acid salt on the surface, an anionic self-dispersible pigment or a cationic self-dispersible pigment.

6. Other Additives

The additives that may be used in the ink and processing solution will be described below.

In an ink and a processing solution, a surfactant may be used. As a surfactant in the present invention, a compound having a structure having both of a hydrophilic part and a hydrophobic part in a molecule may be effectively used, and any of an anionic surfactant, a cationic surfactant, an amphoteric surfactant, and a nonionic surfactant may be used. Further, the aforementioned polymer substance (polymer dispersant) may be also used as a surfactant.

As the anionic surfactant, alkylbenzenesulfonate salt, alkylphenylsulfonate salt, alkylnaphthalenesulfonate salt, higher fatty acid salt, sulfate ester salt of higher fatty acid ester, sulfonate salt of higher fatty acid ester, sulfate ester salt and sulfonate salt of higher alcohol ether, higher alkylsulfosuccinate salt, higher alkylphosphate ester salt, and phosphate ester salt of higher alcohol ethylene oxide adduct may be used. Specifically, for example, dodecylbenzenesulfonate salt, kerylbenzenesulfonate salt, isopropylnaphthalenesulfonate salt, monobutylphenylphenolmonosulfonate salt, monobutylbiphenylsulfonate salt, monobutylbiphenylsulfonate salt, and dibutylphenylphenoldisulfonate salt may be effectively used.

Examples of the nonionic surfactant include polypropylene glycol ethylene oxide adduct, polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, fatty acid alkylolamide, acetylene glycol, oxyethylene adduct of acetylene glycol, aliphatic alkanolamide, glycerin ester, and sorbitan ester.

Examples of the cationic surfactant include a tetraalkylammonium salt, an alkylamine salt, a benzalkonium salt, alkylpyridinium salt, and an imidazolium salt, specifically, for example, dihydroxyethylstearylamine, 2-heptadecenyl-hydroxyethylimidazoline, lauryldimethylbenzylammonium chloride, cetylpyridinium chloride, and stearamidomethylpyridinium chloride.

Besides, biosurfactants such as spicryspolic acid, rhamnolipid, and lysolecithin may be also used.

The amount of the surfactant added to the ink and processing solution of an exemplary embodiment is preferably approximately 10% by mass or less, more preferably in a range approximately from 0.01 to 5% by mass, and furthermore preferably in a range approximately from 0.01 to 3% by mass.

Besides, polyethyleneimine, polyamines, polyvinylpyrrolidone, polyethylene glycol, cellulose derivatives such as ethylcellulose, and carboxymethylcellulose, polysaccharides and derivatives thereof, water-soluble polymer, polymer emulsion such as acryl-based polymer emulsion, polyurethane-based emulsion, and hydrophilic latex, hydrophilic polymer gel, cyclodextrin, macrocyclic amines, dendrimer, crown ethers, urea and derivatives thereof, acetamide, silicone-based surfactant, and fluorine-based surfactant may be added to an ink and a processing solution.

In addition, compounds of alkali metals such as potassium hydroxide, sodium hydroxide, and lithium hydroxide, nitrogen-containing compounds such as ammonium hydroxide, triethanolamine, diethanolamine, ethanolamine, and 2-amino-2-methyl-1-propanol, compounds of alkaline earth metals such as calcium hydroxide, acids such as sulfuric acid, hydrochloric acid, and nitric acid, and salts of strong acids and weak alkalis such as ammonium sulfate may be added.

If necessary, pH buffers, antioxidants, anti-mold agents, viscosity adjusting agents, electric conductive agents, or ultraviolet absorbing agents may be added.

Examples of the present invention will be explained below, but the present invention is not limited to these Examples at all.

EXAMPLES

Example 1

<Preparation Method of Liquid>

Adequate quantities of the colorant, water soluble solvent, surfactant and ion-exchange water are added so as to provide a following predetermined composition, and they are mixed with stirring. The resulting liquid is allowed to pass through a 5 μm filter to obtain a desired liquid.

(Ink Set 1)

Black Ink:

| | |
|---|---|
| CABOJET-300 (manufactured by Cabot): | 4% by mass |
| Styrene-acrylic acid copolymer (acid value 100/neutralization ratio 95%): | 0.5% by mass |
| Diethyleneglycol: | 25% by mass |
| Acetyleneglycol-ethyleneoxide adduct: | 0.2% by mass |
| Ion-exchange water: | balance |

This Black Ink has the pH of 7.4, the surface tension of 31 mN/n, and the viscosity of 3.2 mPa·s.

Cyan Ink:

| | |
|---|---|
| C.I. PIGMENT BLUE 15:3 (sulfonic acid group): | 4% by mass |
| Styrene-acrylic acid copolymer (acid value 100/neutralization ratio 95%): | 0.6% by mass |
| Diethyleneglycol: | 20% by mass |
| Propyleneglycol: | 5% by mass |
| Acetyleneglycol ethyleneoxide adduct: | 1% by mass |
| Ion-exchange water: | balance |

This Cyan Ink has the pH of 7.4, the surface tension of 32mN/n, and the viscosity of 3.1 mPa·s.

Magenta Ink:

| | |
|---|---|
| C.I. PIGMENT RED 122 (sulfonic acid group): | 4% by mass |
| Styrene-acrylic acid copolymer (acid value 100/neutralization ratio 95%): | 0.6% by mass |
| Diethyleneglycol: | 20% by mass |
| Triethyleneglycol: | 5% by mass |
| Acetyleneglycol ethyleneoxide adduct: | 1% by mass |
| Ion-exchange water: | balance |

This Magenta Ink has the pH of 7.6, the surface tension of 32 mN/n, and the viscosity of 3.2 mPa·s.

Yellow Ink:

| | |
|---|---|
| C.I. PIGMENT YELLOW 128 (sulfonic acid group): | 4% by mass |
| Styrene-acrylic acid copolymer (acid value 100/neutralization ratio 95%): | 0.6% by mass |
| Diethyleneglycol: | 20% by mass |
| 2-pyrrolidone: | 5% by mass |
| Acetyleneglycol ethyleneoxide adduct: | 1% by mass |
| Ion-exchange water: | balance |

This Yellow Ink has the pH of 7.8, the surface tension of 32 mN/n, and the viscosity of 2.9 mPa·s.

(Processing Solution 1)

| | |
|---|---|
| Diethyleneglycol: | 30% by mass |
| Magnesium sulfate hexahydrate: | 7.5% by mass |
| Acetyleneglycol ethyleneoxide adduct: | 1% by mass |
| Ion-exchange water: | balance |

This Processing solution 1 has the pH of 5.6, the surface tension of 31 mN/n, and the viscosity of 2.9 mPa·s.

<Imaging>

The image is printed using an image recording test apparatus of a liquid printing system which is capable of double-sided printing with a recording head having a printing area of a entire width of a recording medium, and a plane paper sheet (trade name: FX-L paper sheet, manufactured by Fuji Xerox Co., Ltd.).

The processing solution and ink are ejected by a thermal ink-jet recording method using a test print head having a 256 nozzles at a resolution of 800 dpi.

The image is formed so that the dots of the colors in ink set 1 are overlapped to one another after ejecting the processing solution.

In the single-sided printing mode, plural pulses are applied so that the volume of the ink drop is 8 pl. Hereinafter, the volume of the drop of 8 pl is assumed as 100% of the proportion of the ink applied.

In the double-sided printing mode, A solid-patch image (3 cm square) is printed by controlling the proportion of the processing solution applied to 25% (volume of the drop: 2 pl).

In the double-sided printing mode, the image of the solid-patch (3 cm square) is printed so that images of a front surface and a back surface are overlapped. Ejection of the ink is adjusted by plural pulses so that the proportion of the ink applied is 90% (the volume of the drop: 7.2 pl, reduction ratio: 10%), while ejection of the processing solution is adjusted by plural pulses so that the proportion of the processing solution applied is 20% (the volume of the drop: 1.6 pl, reduction ratio: 20%).

The printed image is measured and evaluated under an ordinary circumstance (temperature: 23±0.5° C., humidity: 55±5% RH).

<Evaluation Method>

(Measurement of Optical Density)

After allowing the printed paper sheet to stand in an ordinary environment for 24 hours, the optical density of the image printed on the back face of the printing sheet (the second printed surface side) is measured with an optical densitometer (trade name: X-RITE 404, manufactured by X-Rite).

The optical density is evaluated by the following criteria. The results are shown in Table 1. The ranks A and B are within practically acceptable ranges.

—Evaluation Criteria of Optical Density—

A: 1.5 or higher

B: 1.1 or higher and less than 1.15

C: less than 1.1

(Standby Time of Printing)

3 cm square Solid patches are printed with different amount of the ink and the processing solution applied using an evaluation machine having a test printing head with resolution of 800 dpi, a paper feed unit having a variable paper feed speed by itself, and a nip pressure variable roller unit (corresponds to a roller for feeding the paper sheet to the double-sided printing paper inversion unit), and the paper sheet is allowed to pass through a roller unit with the paper feed unit. The nip pressure is about 2 MPa.

The degree of reduction of the optical density at the solid patch image portion of the paper sheet after passing through the roller is measured. Decrease of the optical density was remarkable at the portion after passing through the roller when the ink is not sufficiently dried.

"Standby time of printing" is defined as a standby time so that a difference of the optical density between a portion of a paper sheet passed through roller and a portion of a paper sheet passed through roller is 0.02 or less. The standby time of printing is varied by changing the feed speed of the paper sheet.

The standby time of printing is evaluated by the following criteria. The ranks A and B are within practically acceptable ranges.

—Evaluation Criteria of Standby Time of Printing—

A: standby time of less than 1 second

B: standby time from 1 second or more to less than 2 seconds

C: standby time of more than 2 seconds

Example 2

An image is formed and evaluated by the same method as in Example 1, except that the double-sided printing mode with the amount of the ink applied of 90% (reduction ratio 10%) and the amount of the processing solution applied of 20% (reduction ratio 20%) in Example 1 is changed so that the amount of the ink applied is 90% (reduction ratio 10%) and the amount of processing solution applied is 15% (reduction ratio 40%). The results are shown in Table 1.

Example 3

An image is formed and evaluated by the same method as in Example 1, except that the double-sided printing mode with the amount of the ink applied of 90% (reduction ratio 10%) and the amount of the processing solution applied of 20% (reduction ratio 20%) in Example 1 is changed so that the amount of the ink applied is 90% (reduction ratio 10%) and the amount of processing solution applied is 10% (reduction ratio 60%). The results are shown in Table 1.

Example 4

An image is formed and evaluated by the same method as in Example 1, except that the double-sided printing mode with the amount of the ink applied of 90% (reduction ratio 10%) and the amount of the processing solution applied of 20% (reduction ratio 20%) in Example 1 is changed so that the amount of the ink applied is 80% (reduction ratio 20%) and the amount of processing solution applied is 10% (reduction ratio 60%). The results are shown in Table 1.

Example 5

An image is formed and evaluated by the same method as in Example 1, except that the double-sided printing mode with the amount of the ink applied of 90% (reduction ratio 10%) and the amount of the processing solution applied of 20% (reduction ratio 20%) in Example 1 is changed so that the amount of the ink applied is 80% (reduction ratio 20%) and the amount of processing solution applied is 5% (reduction ratio 80%). The results are shown in Table 1.

Comparative Example 1

An image is formed and evaluated by the same method as in Example 1, except that the double-sided printing mode with the amount of the ink applied of 90% (reduction ratio 10%) and the amount of the processing solution applied of 20% (reduction ratio 20%) in Example 1 is changed so that the amount of the ink applied is 100% (reduction ratio 0%) and the amount of processing solution applied is 25% (reduction ratio 0%). The results are shown in Table 1.

Comparative Example 2

An image is formed and evaluated by the same method as in Example 1, except that the double-sided printing mode with the amount of the ink applied of 90% (reduction ratio 10%) and the amount of the processing solution applied of 20% (reduction ratio 20%) in Example 1 is changed so that the amount of the ink applied is 90% (reduction ratio 10%) and the amount of processing solution applied is 25% (reduction ratio 0%). The results are shown in Table 1.

Comparative Example 3

An image is formed and evaluated by the same method as in Example 1, except that the double-sided printing mode with the amount of the ink applied of 90% (reduction ratio 10%) and the amount of the processing solution applied of 20% (reduction ratio 20%) in Example 1 is changed so that the amount of the ink applied is 90% (reduction ratio 10%) and the amount of processing solution applied is 23% (reduction ratio 8%). The results are shown in Table 1.

Comparative Example 4

An image is formed and evaluated by the same method as in Example 1, except that the double-sided printing mode with the amount of the ink applied of 90% (reduction ratio 10%) and the amount of the processing solution applied of 20% (reduction ratio 20%) in Example 1 is changed so that the amount of the ink applied is 80% (reduction ratio 20%) and the amount of processing solution applied is 22.5% (reduction ratio 10%). The results are shown in Table 1.

Comparative Example 5

An image is formed and evaluated by the same method as in Example 1, except that the double-sided printing mode with the amount of the ink applied of 90% (reduction ratio 10%) and the amount of the processing solution applied of 20% (reduction ratio 20%) in Example 1 is changed so that the amount of the ink applied is 100% (reduction ratio 0%) and processing solution is not applied. The results are shown in Table 1.

Reference Example

The standby time of printing in the single-sided printing mode (amount of the ink applied: 100%, amount of the processing solution applied: 25%) is 0.4 seconds.

The standby time of the single-sided printing mode is evaluated by the same method as in the double-sided printing mode, except that the nip pressure of 2 MPa in the evaluation of the standby time of printing in the double-sided printing mode is changed to 0.04 MPa in the single-sided printing mode.

TABLE 1

| | Ink | | | Processing solution | | | | |
|---|---|---|---|---|---|---|---|---|
| | Drop Volume (pl) | Amount of Application (%) | Reduction Ratio (%) | Drop Volume (pl) | Amount of Application (%) | Reduction Ratio (%) | Optical Density | Standby Time of Printing |
| Example 1 | 7.2 | 90 | 10 | 1.6 | 20 | 20 | 1.24 | 1.5 |
| Example 2 | 7.2 | 90 | 10 | 1.2 | 15 | 40 | 1.22 | 1.1 |

TABLE 1-continued

| | Ink | | | Processing solution | | | | |
|---|---|---|---|---|---|---|---|---|
| | Drop Volume (pl) | Amount of Application (%) | Reduction Ratio (%) | Drop Volume (pl) | Amount of Application (%) | Reduction Ratio (%) | Optical Density | Standby Time of Printing |
| Example 3 | 7.2 | 90 | 10 | 0.8 | 10 | 60 | 1.21 | 0.8 |
| Example 4 | 6.4 | 80 | 20 | 0.8 | 10 | 60 | 1.17 | 0.6 |
| Example 5 | 6.4 | 80 | 20 | 0.4 | 5 | 80 | 1.14 | 0.4 |
| Comparative Example 1 | 8 | 100 | 0 | 2 | 25 | 0 | 1.32 | 2.8 |
| Comparative Example 2 | 7.2 | 90 | 10 | 2 | 25 | 0 | 1.28 | 2.6 |
| Comparative Example 3 | 7.2 | 90 | 10 | 1.84 | 23 | 8 | 1.27 | 2.5 |
| Comparative Example 4 | 6.4 | 80 | 20 | 1.8 | 22.5 | 10 | 1.26 | 2.2 |
| Comparative Example 5 | 8 | 100 | 0 | 0 | 0 | — | 1.06 | 0.2 |

In Table 1, "—" means that item is not correspond to.

Examples 6 to 10

While the drop volume of the ink is 8 pl and the drop volume of the processing solution is 2 pl (25% with regard to the amount of the ink applied) in the single-sided printing mode in Example 1, the drop volume of the ink is 10 pl (application ratio 100%) and the drop volume of the processing solution is 2.5 pl (25% with regard to the amount of the ink applied) in the single-sided printing mode in Example 6. The image formed is evaluated by the same method as in Example 1 except the above-mentioned conditions.

The image is formed by the same method as in Example 2 to 5, except that the drop volume of the ink is 10 pl (application ratio 100%) and the drop volume of the processing solution is 2.5 pl (25% with regard to the amount of the ink applied) in the single-sided printing mode in Examples 7 to 10. The image formed is evaluated by the same method as in Examples 1 except the above-mentioned conditions.

The results of evaluation are shown in Table 2.

Comparative Examples 6 to 10

The image is formed by the same method as in Comparative Examples 1 to 5 and is evaluated by the same method as in Example 1, except that drop volume of the ink is 10 pl (application ratio 100%) and the drop volume of the processing solution is 2.5 pl (25% with regard to the amount of the ink applied) in the single-sided printing mode in Comparative Examples 6 to 10.

The results of evaluation are shown in Table 2.

TABLE 2

| | Ink | | | Processing solution | | | | |
|---|---|---|---|---|---|---|---|---|
| | Drop Volume (pl) | Amount of Application (%) | Reduction Ratio (%) | Drop Volume (pl) | Amount of Application (%) | Reduction Ratio (%) | Optical Density | Standby Time of Printing |
| Example 1 | 9 | 90 | 10 | 2.0 | 20 | 20 | 1.31 | 1.8 |
| Example 2 | 9 | 90 | 10 | 1.5 | 15 | 40 | 1.27 | 1.2 |
| Example 3 | 9 | 90 | 10 | 1.0 | 10 | 60 | 1.25 | 1.0 |
| Example 4 | 8 | 80 | 20 | 1.0 | 10 | 60 | 1.21 | 0.8 |
| Example 5 | 8 | 80 | 20 | 0.5 | 5 | 80 | 1.18 | 0.6 |
| Comparative Example 1 | 10 | 100 | 0 | 2.5 | 25 | 0 | 1.4 | 3.5 |
| Comparative Example 2 | 9 | 90 | 10 | 2.5 | 25 | 0 | 1.37 | 3.1 |
| Comparative Example 3 | 9 | 90 | 10 | 2.3 | 2.3 | 8 | 1.36 | 2.8 |
| Comparative Example 4 | 8 | 80 | 20 | 2.25 | 22.5 | 10 | 1.34 | 2.5 |
| Comparative Example 5 | 10 | 100 | 0 | 0 | 0 | — | 1.09 | 0.26 |

In Table 2, "—" means that item is not correspond to.

While the image is printed by the thermal ink-jet recording method in Examples 1 to 10, the respective amounts of the ink and the processing solution applied may also be controlled by the same method in the piezoelectric ink-jet recording method. Since the optical density and standby tine of printing are ascribed to the amounts of the ink and the processing solution applied, the same results in Examples 1 to 10 may be obtained by the piezoelectric ink-jet recording method.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An ink-jet recording apparatus comprising:

a conveyer that conveys a recording medium;

a recording head that ejects an ink and a processing solution onto the recording medium conveyed by the conveyer;

an ejection controller that controls ejection of the ink and the processing solution from the recording head based on image information; and a double side printer that prints on both surfaces of the recording medium to form an image on each surface, the ejection of the ink and the processing solution being controlled by the ejection controller so that respective amounts of the ink and the processing solution applied per unit area are less in a double-sided printing mode, which prints on both surfaces of the recording medium, than respective amounts of the ink and the processing solution applied per unit area in a single-sided printing mode, which prints only on one surface, and so that a reduction ratio of the amount of the ink applied per unit area is larger than a reduction ratio of the amount of the processing solution applied per unit area.

2. The ink-jet recording apparatus according to claim 1, wherein the respective amounts of the ink and the processing solution applied are controlled so that the amount of the ink applied per unit area is approximately from 70 to 95% by volume in a double-sided printing mode when the amount of the ink applied per unit area is assumed to be 100% by volume in a single-sided printing mode, and the amount of the processing solution applied per unit area is approximately from 3 to 20% by volume with regard to the amount of the ink applied per unit area.

3. The ink-jet recording apparatus according to claim 1, wherein the respective amounts of the ink and the processing solution applied are controlled so that the amount of the ink applied per unit area is approximately from 80 to 90% by volume in a double-sided printing mode when the amount of the ink applied per unit area is assumed to be 100% by volume in a single-sided printing mode, and the amount of the processing solution applied per unit area is approximately from 5 to 10% by volume with regard to the amount of the ink applied per unit area.

4. The ink-jet recording apparatus according to claim 1, wherein the ejection controller controls so that the ink is applied after applying the processing solution.

5. The ink-jet recording apparatus according to claim 1, further comprising a heater that heats the recording medium at a position opposed to the recording head via the conveyer, or downstream of the recording head in a direction of conveyance of the recording medium.

6. The ink-jet recording apparatus according to claim 1, wherein the recording head has a printing width wider than a width of a recording area of the recording medium.

7. The ink-jet recording apparatus according to claim 1, wherein the surface tension of the ink is approximately from 25 mN/m to 39 mN/m.

8. The ink-jet recording apparatus of claim 1, wherein the processing solution contains a compound that insolubilizes components in the ink, or a compound that thickens the ink.

* * * * *